US012454653B2

(12) United States Patent
Wang et al.

(10) Patent No.: US 12,454,653 B2
(45) Date of Patent: Oct. 28, 2025

(54) GASOLINE ADDITIVE COMPOSITION FOR IMPROVED ENGINE PERFORMANCE

(71) Applicant: Afton Chemical Corporation, Richmond, VA (US)

(72) Inventors: Janice Jianzhao Wang, Glen Allen, VA (US); Andre Williams, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 31 days.

(21) Appl. No.: 18/535,219

(22) Filed: Dec. 11, 2023

(65) Prior Publication Data

US 2025/0188377 A1 Jun. 12, 2025

(51) Int. Cl.
*C10L 10/18* (2006.01)
*C10L 1/2383* (2006.01)

(52) U.S. Cl.
CPC ..... *C10L 1/2383* (2013.01); *C10L 10/18* (2013.01); *C10L 2200/0423* (2013.01)

(58) Field of Classification Search
CPC . C10L 1/2383; C10L 10/18; C10L 2200/0423
See application file for complete search history.

(56) References Cited

U.S. PATENT DOCUMENTS

| | | | |
|---|---|---|---|
| 2,129,264 | A | 9/1938 | Downing et al. |
| 2,425,755 | A | 8/1947 | Roberts et al. |
| 2,425,845 | A | 8/1947 | Toussaint et al. |
| 2,448,664 | A | 9/1948 | Fife et al. |
| 2,457,139 | A | 12/1948 | Fife et al. |
| 2,475,755 | A | 7/1949 | Pearson |
| 2,568,876 | A | 9/1951 | White et al. |
| 2,886,423 | A | 5/1959 | Kozikowski |
| 3,015,668 | A | 1/1962 | Kozikowski |
| 3,018,250 | A | 1/1962 | Anderson et al. |
| 3,027,246 | A | 3/1962 | Bartlett |
| 3,092,474 | A | 6/1963 | Ebner |
| 3,172,892 | A | 3/1965 | Le Suer et al. |
| 3,198,613 | A | 8/1965 | Udelhofen |
| 3,202,678 | A | 8/1965 | Stuart et al. |
| 3,216,936 | A | 11/1965 | Le Suer et al. |
| 3,219,666 | A | 11/1965 | Norman et al. |
| 3,254,025 | A | 5/1966 | Le Suer |
| 3,272,746 | A | 9/1966 | Le Suer et al. |
| 3,361,673 | A | 1/1968 | Stuart et al. |
| 3,468,640 | A | 9/1969 | Barusch et al. |
| 3,676,089 | A | 7/1972 | Morris et al. |
| 3,778,371 | A | 12/1973 | Malec |
| 4,038,043 | A | 7/1977 | Garth |
| 4,056,531 | A | 11/1977 | Malec |
| 4,067,698 | A | 1/1978 | Steckel |
| 4,152,499 | A | 5/1979 | Boerzel et al. |
| 4,171,959 | A | 10/1979 | Vartanian |
| 4,231,759 | A | 11/1980 | Udelhofen et al. |
| 4,234,435 | A | 11/1980 | Meinhardt et al. |
| 4,248,719 | A | 2/1981 | Chafetz et al. |
| 4,253,980 | A | 3/1981 | Hammond et al. |
| 4,326,973 | A | 4/1982 | Hammond et al. |
| 4,338,206 | A | 7/1982 | Hammond et al. |
| 4,482,357 | A | 11/1984 | Hanlon |
| 4,605,808 | A | 8/1986 | Samson et al. |
| 4,613,341 | A | 9/1986 | Zaweski et al. |
| 4,729,769 | A | 3/1988 | Schlicht et al. |
| 4,787,916 | A | 11/1988 | Feldman |
| 4,844,714 | A | 7/1989 | Vogel et al. |
| 4,877,416 | A | 10/1989 | Campbell et al. |
| 5,024,677 | A | 6/1991 | Wang |
| 5,250,174 | A | 10/1993 | Hart |
| 5,254,138 | A | 10/1993 | Kurek |
| 5,266,223 | A | 11/1993 | Song et al. |
| 5,330,667 | A | 7/1994 | Tiffany, III |
| 5,393,309 | A | 2/1995 | Cherpeck |
| 5,514,190 | A | 5/1996 | Cunningham et al. |
| 5,518,511 | A | 5/1996 | Russel et al. |
| 5,575,823 | A | 11/1996 | Wallace et al. |
| 5,620,486 | A | 4/1997 | Cherpeck |
| 5,634,951 | A | 6/1997 | Colucci et al. |
| 5,697,988 | A | 12/1997 | Malfer et al. |
| 5,725,612 | A | 3/1998 | Malfer et al. |
| 5,752,989 | A | 5/1998 | Henly et al. |
| 5,756,428 | A | 5/1998 | Emert et al. |
| 5,800,103 | A | 9/1998 | Malfer et al. |
| 5,814,111 | A | 9/1998 | Graham et al. |
| 5,873,917 | A | 2/1999 | Daly |
| 5,876,468 | A | 3/1999 | Moreton |
| 6,048,373 | A | 4/2000 | Malfer et al. |
| 6,166,238 | A | 12/2000 | Filipkowski et al. |
| 6,405,711 | B1 | 6/2002 | Smith et al. |
| 6,458,172 | B1 | 10/2002 | Macduff et al. |
| 6,462,014 | B1 | 10/2002 | Johnson |
| 6,475,250 | B2 | 11/2002 | Krull et al. |
| 6,548,458 | B2 | 4/2003 | Loper |
| 6,695,890 | B1 | 2/2004 | Hazel et al. |

(Continued)

FOREIGN PATENT DOCUMENTS

| | | | |
|---|---|---|---|
| CA | 2089833 | A1 | 8/1993 |
| CN | 1256302 | A | 6/2000 |

(Continued)

OTHER PUBLICATIONS

Yau et al., "Modern Size Exclusion Liquid Chromatography", John Wiley and Sons, New York, 1979.

(Continued)

*Primary Examiner* — Ellen M McAvoy
*Assistant Examiner* — Chantel Graham
(74) *Attorney, Agent, or Firm* — Honigman LLP

(57) ABSTRACT

The present disclosure provides fuel additives including Mannich detergent additive(s) and Mannich-based quaternary ammonium salt detergent additive(s) effective to improve engine performance in both port fuel injected and gasoline direct injection engines.

22 Claims, No Drawings

(56) References Cited

U.S. PATENT DOCUMENTS

| | | | |
|---|---|---|---|
| 6,730,773 | B2 | 5/2004 | Heinen |
| 6,800,103 | B2 | 10/2004 | Malfer et al. |
| 6,867,171 | B2 | 3/2005 | Harrison et al. |
| 7,297,675 | B2 | 11/2007 | Alef |
| 7,402,185 | B2 | 7/2008 | Aradi et al. |
| 7,435,272 | B2 | 10/2008 | Aradi et al. |
| 7,704,289 | B2 | 4/2010 | Alters et al. |
| 7,744,660 | B2 | 6/2010 | Burrington et al. |
| 7,766,982 | B2 | 8/2010 | Colucci et al. |
| 7,906,470 | B2 | 3/2011 | Stevenson et al. |
| 7,947,093 | B2 | 5/2011 | Barton et al. |
| 7,951,211 | B2 | 5/2011 | Barton et al. |
| 8,097,570 | B2 | 1/2012 | Boutout et al. |
| 8,231,695 | B2 | 7/2012 | Cunningham et al. |
| 8,425,627 | B2 | 4/2013 | Dietz et al. |
| 8,449,630 | B2 | 5/2013 | Lange et al. |
| 8,475,541 | B2 | 7/2013 | Fang et al. |
| 8,486,876 | B2 | 7/2013 | Brewer et al. |
| 8,496,716 | B2 | 7/2013 | Lange et al. |
| 8,557,003 | B2 | 10/2013 | Malfer et al. |
| 8,778,034 | B2 | 7/2014 | Cunningham |
| 8,863,700 | B2 | 10/2014 | Fang et al. |
| 8,894,726 | B2 | 11/2014 | Fang et al. |
| 8,961,623 | B2 | 2/2015 | Stevenson et al. |
| 8,974,551 | B1 | 3/2015 | Fang et al. |
| 9,062,265 | B2 | 6/2015 | Reid et al. |
| 9,340,742 | B1 | 5/2016 | Fang et al. |
| 9,464,252 | B2 | 10/2016 | Schwab et al. |
| 10,781,411 | B2 | 9/2020 | Bartley et al. |
| 2003/0014910 | A1 | 1/2003 | Aradi et al. |
| 2003/0131527 | A1 | 7/2003 | Colucci et al. |
| 2004/0029766 | A1 | 2/2004 | Frick et al. |
| 2004/0060226 | A1 | 4/2004 | Bongart et al. |
| 2004/0167040 | A1 | 8/2004 | Dahlmann et al. |
| 2005/0066572 | A1 | 3/2005 | Colucci et al. |
| 2005/0120619 | A1 | 6/2005 | Koch et al. |
| 2005/0215411 | A1 | 9/2005 | Mackney et al. |
| 2006/0070293 | A1 | 4/2006 | Lange et al. |
| 2006/0168876 | A1 | 8/2006 | Colucci et al. |
| 2006/0196110 | A1 | 9/2006 | Schwahn et al. |
| 2006/0196111 | A1 | 9/2006 | Colucci et al. |
| 2006/0272597 | A1 | 12/2006 | Burrington et al. |
| 2007/0015681 | A1 | 1/2007 | Allef et al. |
| 2007/0193119 | A1 | 8/2007 | Hoffman |
| 2007/0245621 | A1 | 10/2007 | Malfter et al. |
| 2008/0086936 | A1 | 4/2008 | Cunningham et al. |
| 2008/0113890 | A1 | 5/2008 | Moreton et al. |
| 2008/0307698 | A1 | 12/2008 | Barton et al. |
| 2009/0049740 | A1 | 2/2009 | Hurst |
| 2009/0235576 | A1 | 9/2009 | Volkel et al. |
| 2009/0282731 | A1 | 11/2009 | Malfer et al. |
| 2010/0005706 | A1 | 1/2010 | Burgazli et al. |
| 2010/0024289 | A1 | 2/2010 | Smith et al. |
| 2010/0037513 | A1 | 2/2010 | Petrucci et al. |
| 2010/0037514 | A1 | 2/2010 | Malfer et al. |
| 2010/0132253 | A1 | 6/2010 | Kaufman et al. |
| 2010/0151396 | A1 | 6/2010 | Papachristos et al. |
| 2010/0236510 | A1 | 9/2010 | Shea et al. |
| 2011/0162263 | A1 | 7/2011 | Vilardo et al. |
| 2011/0185626 | A1 | 8/2011 | Barton et al. |
| 2011/0237469 | A1 | 9/2011 | Khandekar et al. |
| 2011/0258917 | A1 | 10/2011 | Garcia Castro et al. |
| 2011/0302828 | A1 | 12/2011 | Fang et al. |
| 2011/0308550 | A1 | 12/2011 | Reid |
| 2011/0315107 | A1 | 12/2011 | Grabarse et al. |
| 2012/0010112 | A1 | 1/2012 | Grabarse et al. |
| 2012/0291339 | A1 | 11/2012 | Martin et al. |
| 2013/0031827 | A1 | 2/2013 | Reid et al. |
| 2013/0031828 | A1 | 2/2013 | Reid et al. |
| 2013/0104826 | A1 | 5/2013 | Burgess et al. |
| 2013/0220255 | A1 | 8/2013 | Fang |
| 2013/0227878 | A1 | 9/2013 | Wolf et al. |
| 2013/0233267 | A1 | 9/2013 | Barbour |
| 2013/0237466 | A1 | 9/2013 | Lange et al. |
| 2013/0247450 | A1 | 9/2013 | Wolf |
| 2013/0255139 | A1 | 10/2013 | Dolmazon et al. |
| 2013/0296210 | A1 | 11/2013 | Hansch et al. |
| 2013/0298948 | A1 | 11/2013 | Company et al. |
| 2013/0312318 | A1 | 11/2013 | Peretolchin et al. |
| 2013/0324665 | A1 | 12/2013 | Shaikh et al. |
| 2013/0333650 | A1 | 12/2013 | Fang et al. |
| 2014/0157655 | A1 | 6/2014 | Tort et al. |
| 2014/0174390 | A1 | 6/2014 | Reid et al. |
| 2015/0033617 | A1 | 2/2015 | Arondel et al. |
| 2015/0252277 | A1 | 9/2015 | Hansch et al. |
| 2016/0272912 | A1 | 9/2016 | Voelkel et al. |
| 2016/0289584 | A1* | 10/2016 | Russo ..... C10L 10/08 |
| 2020/0283691 | A1* | 9/2020 | Raj Mohan ..... C10L 1/221 |
| 2023/0077913 | A1* | 3/2023 | Schwab ..... C10L 1/221 44/415 |
| 2024/0132792 | A1* | 4/2024 | Brennan ..... C10L 1/1852 |

FOREIGN PATENT DOCUMENTS

| | | | |
|---|---|---|---|
| CN | 101671584 | B | 3/2010 |
| DE | 102022114694 | A1 | 8/2022 |
| EP | 0016312 | A1 | 10/1980 |
| EP | 0293192 | A1 | 11/1988 |
| EP | 0565285 | A1 | 10/1993 |
| EP | 1293553 | A2 | 3/2003 |
| EP | 1344785 | A1 | 9/2003 |
| EP | 1411105 | A2 | 4/2004 |
| EP | 1518918 | A1 | 3/2005 |
| EP | 1918355 | A1 | 5/2008 |
| EP | 2033945 | A1 | 3/2009 |
| EP | 2674471 | A1 | 12/2013 |
| EP | 2987845 | A1 | 2/2016 |
| EP | 3597726 | A1 | 1/2020 |
| EP | 4141091 | A1 | 3/2023 |
| GB | 842728 | A1 | 7/1960 |
| GB | 949981 | A | 2/1964 |
| GB | 2493377 | A | 2/2013 |
| WO | 2004050806 | A2 | 6/2004 |
| WO | 2005023965 | A1 | 3/2005 |
| WO | 2006135881 | A2 | 12/2006 |
| WO | 2007015080 | A1 | 2/2007 |
| WO | 2010132209 | A1 | 11/2010 |
| WO | 2013000738 | A2 | 1/2013 |
| WO | 2013017889 | A1 | 2/2013 |
| WO | 2013070503 | A1 | 5/2013 |
| WO | 2013092533 | A1 | 6/2013 |
| WO | 2015011505 | A1 | 1/2015 |
| WO | 2017168312 | A1 | 10/2017 |
| WO | 2019079246 | A1 | 4/2019 |

OTHER PUBLICATIONS

Smith, S. Scott et al. Measurement and Control of Fuel Injector Deposits in Direct Injection Gasoline Vehicles, SAE International; Oct. 14, 2013. doi: 10.4271/2013-01-2616.

Extended European Search Report, Application No. EP 24215274.2 dated Apr. 28, 2025.

* cited by examiner

GASOLINE ADDITIVE COMPOSITION FOR IMPROVED ENGINE PERFORMANCE

TECHNICAL FIELD

This disclosure is directed to fuel additives for spark-ignition engines providing enhanced engine, intake valve, and/or injector performance, to fuel compositions including such additives, and to methods for using such fuel additives in a fuel composition for improved performance.

BACKGROUND

Fuel compositions for vehicles are continually being improved to enhance various properties of the fuels in order to accommodate their use in newer, more advanced engines including both gasoline port fuel injected (PFI) engines as well as gasoline direct injected (GDI) engines. Often, improvements in fuel compositions center around improved fuel additives and other components used in the fuel. For example, friction modifiers may be added to fuel to reduce friction and wear in the fuel delivery systems of an engine. Other additives may be included to reduce the corrosion potential of the fuel or to improve the conductivity properties. Still other additives may be blended with the fuel to improve fuel economy. Engine and fuel delivery system deposits represent another concern with modern combustion engines, and therefore other fuel additives often include various deposit control additives to control and/or mitigate engine deposit problems. Thus, fuel compositions typically include a complex mixture of additives.

However, there remain challenges when attempting to balance such a complex assortment of additives. For example, some of the conventional fuel additives may be beneficial for one characteristic or one type of engine, but at the same time be detrimental to another characteristic of the fuel. In some instances, fuel additives effective in gasoline port fuel injection engines (PFI) do not necessarily provide comparable performance in gasoline direct injection engines (GDI) and vice versa. In yet other circumstances, fuel additives often require an unreasonably high treat rate to achieve desired effects, which tends to place undesirable limits on the available amounts of other additives in the fuel composition. Yet other fuel additives tend to be expensive and/or difficult to manufacture or incorporate in fuels.

SUMMARY

In one embodiment or approach, a fuel additive for a spark-ignition engine is provided that includes a detergent including one or more Mannich detergent additives and one or more Mannich-based quaternary ammonium salt detergent additives. In one aspect, the one or more Mannich detergent additives include the reaction product of a hydrocarbyl-substituted phenol or cresol, one or more aldehydes, and one or more amines. In another aspect, the one or more Mannich-based quaternary ammonium salt detergent additives include (i) a Mannich reaction product or derivative thereof having at least one tertiary amino group and prepared from a hydrocarbyl-substituted phenol, cresol, or derivative thereof, an aldehyde, and a hydrocarbyl amine or polyamine providing the tertiary amino group and reacted with (ii) a quaternizing agent selected from the group consisting of a carboxylic or polycarboxylic acid, ester, amide, or salt thereof or halogen substituted derivative thereof. In either aspect, about 2 to about 50 weight percent of the detergent is the one or more Mannich-based quaternary ammonium salt detergent additives.

The fuel additive of the previous paragraph may include one or more optional features or embodiments in any combination. These optional features or embodiments may include one or more of the following: wherein about 2 to about 20 weight percent of the detergent is the one or more Mannich-based quaternary ammonium salt detergent additives; and/or wherein the one or more Mannich detergent additives have the structure of Formula I:

(Formula I)

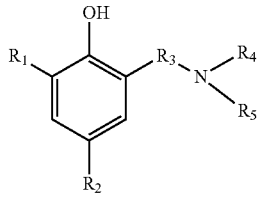

wherein $R_1$ of Formula I is hydrogen or a C1 to C4 alkyl group, $R_2$ of Formula I is a hydrocarbyl group having a number average molecular weight of about 500 to about 3000, $R_3$ of Formula I is a C1 to C4 alkylene or alkenyl group, and $R_4$ and $R_5$ of Formula I are, independently, hydrogen, a C1 to C12 alkyl group, or a C1 to C4 alkyl amino di(C1-C12 alkyl) group; and/or wherein $R_2$ of Formula I is polyisobutenyl having a number average molecular weight of about 500 to about 1500; and/or wherein the detergent includes two Mannich detergent additives, wherein the first Mannich detergent additive has the structure of Formula I with $R_4$ and $R_5$ each being the C1 to C12 alkyl group and the second Mannich detergent additive has the structure of Formula I with $R_4$ being hydrogen and $R_5$ being the di(C1 to C4)alkyl amino C1-C12 alkyl group; and/or wherein the first Mannich detergent additive has the structure of Formula Ia and the second Mannich detergent additive has the structure of Formula Ib:

(Formula Ia)

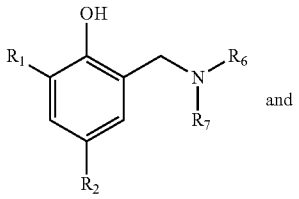

and (Formula Ib)

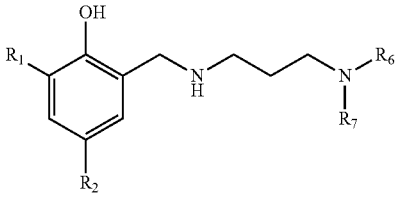

wherein each $R_1$ is independently hydrogen or a C1 to C4 alkyl group, each $R_2$ is independently a hydrocarbyl group having a number average molecular weight of about 500 to about 3000, $R_6$ and $R_7$ are, independently, a C1 to C12 alkyl group; and/or wherein the detergent includes about 10 to about 30 weight percent of the first Mannich detergent additive and about 10 to about 30 weight percent of the second Mannich detergent additive; and/or wherein a weight ratio of the first Mannich detergent additive to the second Mannich detergent additive is about 1:1 to about 2:1; and/or wherein the one or more Mannich-based quaternary ammonium salt detergent additives have the structure of Formula II (Formula II)

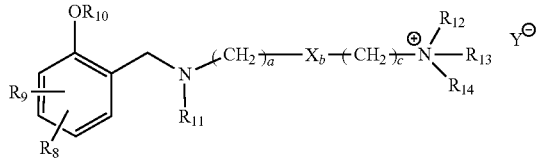

wherein $R_8$ is a hydrocarbyl radical, wherein the number average molecular weight of the hydrocarbyl is about 200 to about 5,000; $R_9$ is hydrogen or a C1-C6 alkyl group; $R_{10}$ is hydrogen or, together with $R_{11}$, a —C(O)— group or a —$CH_2$— group forming a ring structure with the nitrogen atom closest to the aromatic ring; $R_{11}$ is one of hydrogen, $C_1$-$C_6$ alkyl, —$(CH_2)_a$—$NR_5R_6$, —$(CH_2)_a$-Aryl$(R_1)(R_2)(OR_3)$, or together with $R_{10}$, a —C(O)— group or a —$CH_2$— group forming a ring structure with the nitrogen atom closest to the aromatic ring (with each of $R_5$ and $R_6$, independently being a C1 to C12 alkyl group); $R_{12}$ is $C_1$-$C_6$ alkyl or, together with $Y^{\ominus}$, forms a C1-C6 alkyl substituted —$C(O)O^{\ominus}$; $R_{13}$ and $R_{14}$, independently, are $C_1$-$C_6$ alkyl; a is an integer from 1 to 10, b is an integer selected from either 0 or 1, and c is an integer from 0 to 10; X is oxygen or nitrogen; and $Y^{\ominus}$ is an anionic group having a structure $R_{15}C(O)O^{\ominus}$ wherein $R_{15}$ is one of (i) together with $R_{12}$ a $C_1$-$C_6$ alkyl group or (ii) a $C_1$-$C_6$ alkyl, an aryl, a $C_1$-$C_4$ alkylene-C(O)O—$R_2$ or a —C(O)O—$R_2$ group (with $R_2$ being a $C_1$ to $C_6$ alkyl group); and/or wherein $R_8$ of Formula II is a hydrocarbyl radical derived from a polyisobutylene polymer or oligomer, the number average molecular weight being about 500 to about 1,500, $R_9$ of Formula II is hydrogen or a methyl group, $R_{10}$ and $R_{11}$ of Formula II are each hydrogen; a is an integer from 1 to 4, and b and c are each 0; and/or wherein $R_{12}$, $R_{13}$, and $R_{14}$ of Formula II are each $C_1$-$C_6$ alkyl and wherein $Y^{\ominus}$ is the anionic group having the structure $R_{15}C(O)O^{\ominus}$ with $R_{15}$ being the $C_1$-$C_6$ alkyl, an aryl, a $C_1$-$C_4$ alkylene-C(O)O—$R_2$ or a —C(O)O—$R_2$ group; and/or further comprising an alkoxylated alcohol, and wherein a weight ratio of the alkoxylated alcohol to the one or more Mannich detergent additives is about 1.0 or less; and/or wherein the alkoxylated alcohol is a polyether prepared by reacting an alkyl alcohol or an alkylphenol with an alkylene oxide selected from ethylene oxide, propylene oxide, butylene oxide, copolymers thereof, or combinations thereof; and/or wherein the alkoxylated alcohol is a polyether having the structure of Formula VI:

(Formula VI)

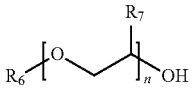

wherein $R_6$ of Formula VI is an aryl group or a linear, branched, or cyclic aliphatic group having 5 to 50 carbons, $R_7$ of Formula VI is a C1 to C4 alkyl group, and n is an integer from 5 to 100; and/or wherein the fuel additive includes about 20 to about 60 weight percent of the one or more Mannich detergent additives, about 1 to about 50 weight percent of the one or more quaternary ammonium salt detergent additives, and about 5 to about 30 weight percent of an alkoxylated alcohol.

In another approach or embodiment, a gasoline fuel composition is provided herein including at least a detergent including one or more Mannich detergent additives and one or more Mannich-based quaternary ammonium salt detergent additives. In one aspect, the fuel composition includes about 15 to about 300 ppmw of the one or more Mannich detergent additives, wherein the Mannich detergent additive is the reaction product of a hydrocarbyl-substituted phenol or cresol, one or more aldehydes, and one or more amines. In another aspect, the fuel includes about 1 to about 200 ppmw of the one or more Mannich-based quaternary ammonium salt detergent additives, wherein the Mannich-based quaternary ammonium salt detergent additive is (i) a Mannich reaction product or derivative thereof having at least one tertiary amino group and prepared from a hydrocarbyl-substituted phenol, cresol, or derivative thereof, an aldehyde, and a hydrocarbyl amine or polyamine providing the tertiary amino group and reacted with (ii) a quaternizing agent selected from the group consisting of a carboxylic or polycarboxylic acid, ester, amide, or salt thereof or halogen substituted derivative thereof. In either aspect, about 2 to about 50 weight percent of the detergent is the one or more Mannich-based quaternary ammonium salt detergent additives. In yet another aspect, the fuel may also optionally include about 5 to about 150 ppmw of an alkoxylated alcohol. The embodiment of the fuel composition may also include any of the optional features or embodiments of the fuel additive as described above and as set forth in this Summary in any combination.

In yet another approach or embodiment, a method of reducing deposits in a gasoline engine using any embodiment of the fuel additive or the fuel composition of this Summary. In one embodiment, the method includes operating a gasoline engine on a fuel composition containing a major amount of a gasoline fuel and a minor amount of a fuel additive by injecting the gasoline fuel through one or more injectors. The fuel additive includes a detergent including one or more Mannich detergent additives and one or more Mannich-based quaternary ammonium salt detergent additives. In one aspect, the one or more Mannich detergent additives includes the reaction product of a hydrocarbyl-substituted phenol or cresol, one or more aldehydes, and one or more amines. In another aspect, the Mannich-based quaternary ammonium salt detergent additive includes (i) a Mannich reaction product or derivative thereof having at least one tertiary amino group and prepared from a hydrocarbyl-substituted phenol, cresol, or derivative thereof, an aldehyde, and a hydrocarbyl amine or polyamine providing the tertiary amino group and reacted with (ii) a quaternizing agent selected from the group consisting of a carboxylic or polycarboxylic acid, ester, amide, or salt thereof or halogen substituted derivative thereof. In any embodiment or aspect of this method, about 2 to about 50 weight percent of the detergent is the one or more Mannich-based quaternary ammonium salt detergent additives. In any embodiment or aspect of this method, the fuel additive reduces deposits in the gasoline engine, and wherein the fuel additive reduces deposits in a port fuel injection (PFI) engine, a gasoline direct injection (GDI) engine, or both, and/or wherein the reduced deposits are reduced injector deposits measured by one of injector pulse width, injection duration, injector flow, or combinations thereof.

The method of the preceding paragraph may include optional features, embodiments, or method steps in any combination. These optional features, embodiments, or method steps may include one or more of the following: wherein the fuel additive reduces deposits when sprayed from an injector configured to spray droplets of about 10 to about 30 microns, about 120 to about 200 microns, or both; and/or wherein about 10 to about 20 weight percent of the detergent is the one or more Mannich-based quaternary ammonium salt detergent additives; and/or wherein the one or more Mannich detergent additives have the structure of Formula I:

(Formula I)

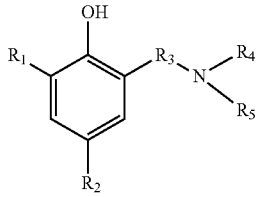

wherein $R_1$ is hydrogen or a C1 to C4 alkyl group, $R_2$ is a hydrocarbyl group having a number average molecular weight of about 500 to about 3000, $R_3$ is a C1 to C4 alkylene or alkenyl group, and $R_4$ and $R_5$ are, independently, hydrogen, a C1 to C12 alkyl group, or a di(C1 to C4)alkyl amino C1-C12 alkyl group; and/or wherein $R_2$ is polyisobutenyl having a number average molecular weight of about 500 to about 1500; and/or wherein the one or more Mannich-based quaternary ammonium salt detergent additives have the structure of Formula II (Formula II)

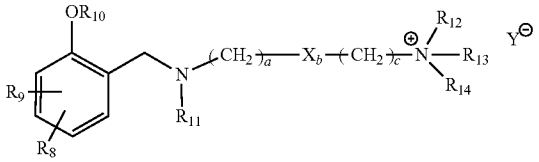

wherein $R_8$ is a hydrocarbyl radical, wherein the number average molecular weight of the hydrocarbyl is about 200 to about 5,000; $R_9$ is hydrogen or a $C_1$-$C_6$ alkyl group; $R_{10}$ is hydrogen or, together with $R_{11}$, a —C(O)— group or a —$CH_2$— group forming a ring structure with the nitrogen atom closest to the aromatic ring; $R_1$ is one of hydrogen, $C_1$-$C_6$ alkyl, —$(CH_2)_a$—$NR_5R_6$, —$(CH_2)_a$-Aryl$(R_1)(R_2)(OR_3)$, or together with $R_{10}$, a —C(O)— group or a —$CH_2$— group forming a ring structure with the nitrogen atom closest to the aromatic ring (with each of $R_5$ and $R_6$, independently being a C1 to C12 alkyl group); $R_{12}$ is $C_1$-$C_6$ alkyl or, together with $Y^{\ominus}$, forms a C1-C6 alkyl substituted —$C(O)O^{\ominus}$; $R_{13}$ and $R_{14}$, independently, are $C_1$-$C_6$ alkyl; a is an integer from 1 to 10, b is an integer selected from either 0 or 1, and c is an integer from 0 to 10; X is oxygen or nitrogen; and $Y^{\ominus}$ is an anionic group having a structure $R_{15}C(O)O^{\ominus}$ wherein $R_{15}$ is one of (i) together with $R_{12}$ a $C_1$-$C_6$ alkyl group or (ii) a $C_1$-$C_6$ alkyl, an aryl, a $C_1$-$C_4$ alkylene-C(O)O—$R_2$ or a —C(O)O—$R_2$ group (with $R_2$ being a $C_1$ to $C_6$ alkyl group); and/or wherein $R_8$ is a hydrocarbyl radical derived from a polyisobutylene polymer or oligomer, the number average molecular weight being about 500 to about 1,500, $R_9$ is hydrogen or a methyl group, $R_{10}$ and $R_{11}$ are each hydrogen; a is an integer from 1 to 4, and b and c are each 0; and/or wherein $R_{12}$, $R_{13}$, and $R_{14}$ are each $C_1$-$C_6$ alkyl and wherein $Y^{\ominus}$ is the anionic group having the structure $R_{15}C(O)O^{\ominus}$ with $R_{15}$ being the $C_1$-$C_6$ alkyl, an aryl, a $C_1$-$C_4$ alkylene-C(O)O—$R_2$ or a —C(O)O—$R_2$ group; and/or further comprising an alkoxylated alcohol and wherein a weight ratio of the alkoxylated alcohol to the Mannich detergent is about 1.0 or less; and/or wherein the alkoxylated alcohol is a polyether prepared by reacting an alkyl alcohol or an alkylphenol with an alkylene oxide selected from ethylene oxide, propylene oxide, butylene oxide, copolymers thereof, or combinations thereof, and/or wherein the alkoxylated alcohol is a polyether having the structure of Formula VI:

(Formula VI)

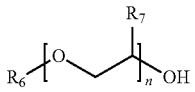

wherein $R_6$ of Formula III is an aryl group or a linear, branched, or cyclic aliphatic group having 5 to 50 carbons, $R_7$ of Formula III is a C1 to C4 alkyl group, and n is an integer from 5 to 100; and/or wherein the fuel additive includes about 20 to about 60 weight percent of the Mannich detergent, about 1 to about 50 weight percent of the one or more Mannich-based quaternary ammonium salt detergent additives, and optionally about 5 to about 30 weight percent of the alkoxylated alcohol; and/or wherein the detergent includes two Mannich detergent additives, wherein the first Mannich detergent additive has the structure of Formula I with $R_4$ and $R_5$ each being the C1 to C12 alkyl group and the second Mannich detergent additive has the structure of Formula I with $R_4$ being hydrogen and $R_5$ being the di(C1 to C4)alkyl amino C1-C12 alkyl group; and/or wherein the first Mannich detergent additive has the structure of Formula Ia and the second Mannich detergent additive has the structure of Formula Ib:

(Formula Ia)

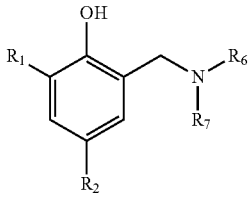

and (Formula Ib)

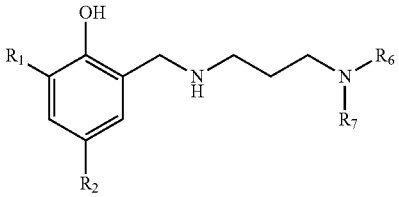

wherein each $R_1$ is independently hydrogen or a C1 to C4 alkyl group, each $R_2$ is independently a hydrocarbyl group having a number average molecular weight of about 500 to about 3000, $R_6$ and $R_7$ are, independently, a C1 to C12 alkyl group; and/or wherein the detergent includes about 10 to about 30 weight percent of the first Mannich detergent additive and about 10 to about 30 weight percent of the second Mannich detergent additive; and/or wherein a weight ratio of the first Mannich detergent additive to the second Mannich detergent additive is about 1:1 to about 2:1

In yet further approaches or embodiments, the use of any embodiment of the fuel additive or fuel composition of this summary is provided for reducing deposits in a gasoline engine, and wherein the use includes any embodiment of the fuel additive or the fuel composition for reducing deposits in a port fuel injection (PFI) engine, a gasoline direct injection (GDI) engine, or both, and/or wherein the reduced deposits are reduced injector deposits measured by one of injector pulse width, injection duration, injector flow, or combinations thereof. Reduced deposits may be intake valve deposits measured by ASTM D6201 and/or injector clean-up measured by any method as set forth in the Examples herein and at least described in in Smith, S. and Imoehl, W., "Measurement and Control of Fuel Injector Deposits in Direct Injection Gasoline Vehicles," SAE Technical Paper 2013-01-2616, 2013, doi:10.4271/2013-01-2616 and/or Shanahan, C., Smith, S., and/or Sears, B., "A General Method for Fouling Injectors in Gasoline Direct Injection Vehicles and the Effects of Deposits on Vehicle Performance," SAE Int. J. Fuels Lubr. 10(3):2017, doi:10.4271/2017-01-2298, both of which are incorporated by reference herein.

DETAILED DESCRIPTION

The present disclosure provides fuel additives including a detergent of one or more Mannich detergent additives and one or more Mannich-based quaternary ammonium salt detergent additives in certain weight ratios to provide improved engine and/or injector performance in both port fuel injection (PFI) engines as well as gasoline direct injection (GDI) engines. The fuel additives, in some approaches, may also include alkoxylated alcohols and, when included, certain ratios of the alkoxylated alcohol to the one or more Mannich detergents. Also provided herein are fuel compositions including the novel fuel additive combinations and methods of using or combusting a fuel including the fuel additive combinations herein to achieve improved engine, intake valve, and/or injector performance. As noted more below, the one or more Mannich detergent additives include the reaction product of a hydrocarbyl-substituted phenol or cresol, one or more aldehydes, and one or more amines; and the one or more quaternary ammonium salt detergent additives are in the form of a Mannich-based quaternary ammonium salt detergent additive and includes (i) a Mannich reaction product or derivative thereof having at least one tertiary amino group and prepared from a hydrocarbyl-substituted phenol, cresol, or derivative thereof, an aldehyde, and a hydrocarbyl amine or polyamine providing the tertiary amino group and reacted with (ii) a quaternizing agent selected from the group consisting of a carboxylic or polycarboxylic acid, ester, amide, or salt thereof or halogen substituted derivative thereof. In preferred embodiments, about 2 to about 50 weight percent of the detergent is the one or more Mannich-based quaternary ammonium salt detergent additives. As shown in the Examples herein, Mannich detergents alone or Mannich-based quaternary ammonium salt detergents alone provide little, or only modest, clean-up performance in GDI engines or PFI engines, but surprisingly achieve enhanced clean-up in both GDI engines and PFI engines when both the Mannich detergent and the Mannich-based quaternary ammonium salt detergent are combined in certain ratios in the fuel additive.

In aspects or embodiments of this disclosure, improved engine, intake valve, and/or injector performance of the fuel additive combinations herein may include one or more of controlling or reducing fuel injector deposits, controlling or reducing intake valve deposits, controlling or reducing combustion chamber deposits and/or controlling or reducing intake valve sticking in PFI engines, GDI engines, or both types of engines. Improved injector performance may also be one or more of improved fuel flow, improved fuel economy, and/or improved engine efficiency as determined via one or more of injector pulse width, injection duration, and/or injector flow. Reduced deposits may be intake valve deposits measured by ASTM D6201 and/or injector clean-up measured by any method as set forth in the Examples herein and at least described in in Smith, S. and Imoehl, W., "Measurement and Control of Fuel Injector Deposits in Direct Injection Gasoline Vehicles," SAE Technical Paper 2013-01-2616, 2013, doi:10.4271/2013-01-2616 and/or Shanahan, C., Smith, S., and/or Sears, B., "A General Method for Fouling Injectors in Gasoline Direct Injection Vehicles and the Effects of Deposits on Vehicle Performance," SAE Int. J. Fuels Lubr. 10(3):2017, doi:10.4271/2017-01-2298, both of which are incorporated by reference herein.

Mannich Detergent

In one aspect, the fuel additives and fuels herein first include one or more Mannich detergents. Suitable Mannich detergents include the reaction product(s) of a hydrocarbyl-substituted (or an alkyl-substituted) hydroxyaromatic or phenol compound, one or more aldehydes, and one or more amines as discussed more below.

In one approach, the hydrocarbyl or alkyl substituents of the hydroxyaromatic compound may include long chain hydrocarbyl or alkyl groups on a benzene ring of the hydroxyaromatic compound and may be derived from an olefin or polyolefin having a number average molecular weight (Mn) from about 500 to about 3000, preferably from about 700 to about 2100, as determined by gel permeation chromatography (GPC) using polystyrene as reference. The polyolefin, in some approaches, may also have a polydispersity (weight average molecular weight/number average molecular weight) of about 1 to about 10 (in other instances, about 1 to about 4 or about 1 to about 2) as determined by GPC using polystyrene as reference.

The alkylation of the hydroxyaromatic or phenol compound is typically performed in the presence of an alkylating catalyst at a temperature in the range of about 0 to about 200° C., preferably 0 to about 100° C. Acidic catalysts are generally used to promote Friedel-Crafts alkylation. Typical catalysts used in commercial production include sulphuric acid, $BF_3$, aluminum phenoxide, methanesulphonic acid, cationic exchange resin, acidic clays and modified zeolites.

Polyolefins suitable for forming the alkyl-substituted hydroxyaromatic compounds of the Mannich detergents include polypropylene, polybutenes, polyisobutylene, copolymers of butylene and/or butylene and propylene, copolymers of butylene and/or isobutylene and/or propylene, and one or more mono-olefinic comonomers copolymerizable therewith (e.g., ethylene, 1-pentene, 1-hexene, 1-octene, 1-decene, etc.) where a copolymer molecule contains at least 50% by weight, of butylene and/or isobutylene and/or propylene units. Any comonomers polymerized with propylene or butenes may be aliphatic and can also contain non-aliphatic groups, e.g., styrene, o-methylstyrene, p-methylstyrene, divinyl benzene and the like if needed. Thus, the resulting polymers and copolymers used in forming the alkyl-substituted hydroxyaromatic compounds are substantially aliphatic hydrocarbon polymers.

Polybutylene is preferred for forming the hydrocarbyl-substituted hydroxyaromatic or phenol compounds herein. Unless otherwise specified herein, the term "polybutylene" is used in a generic sense to include polymers made from "pure" or "substantially pure" 1-butene or isobutene, and polymers made from mixtures of two or all three of 1-butene, 2-butene and isobutene. Commercial grades of such polymers may also contain insignificant amounts of other olefins. So-called high reactivity polyisobutenes having relatively high proportions of polymer molecules having a terminal vinylidene group are also suitable for use in forming the long chain alkylated phenol reactant. Suitable high-reactivity polyisobutenes include those polyisobutenes that comprise at least about 20% of the more reactive methylvinylidene isomer, preferably at least 50% and more preferably at least 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808, which are both incorporated herein by reference.

The Mannich detergent, in some approaches or embodiments, may be made from an alkylphenol or alkylcresol. However, other phenolic compounds may be used including alkyl-substituted derivatives of resorcinol, hydroquinone, catechol, hydroxydiphenyl, benzylphenol, phenethylphenol, naphthol, tolylnaphthol, among others. Preferred for the preparation of the Mannich detergents are the polyalkylphenol and polyalkylcresol reactants, e.g., polypropyl phenol, polybutylphenol, polypropylcresol and polybutylcresol, wherein the alkyl group has a number average molecular weight of about 500 to about 3000 or about 500 to about 2100 as measured by GPC using polystyrene as reference, while the most preferred alkyl group is a polybutyl group derived from polyisobutylene having a number average molecular weight in the range of about 700 to about 1300 as measured by GPC using polystyrene as reference.

The preferred configuration of the alkyl-substituted hydroxyaromatic compound is that of a para-substituted mono-alkylphenol or a para-substituted mono-alkyl orthocresol. However, any hydroxyaromatic compound readily reactive in the Mannich condensation reaction may be employed. Thus, Mannich products made from hydroxyaromatic compounds having only one ring alkyl substituent, or two or more ring alkyl substituents are suitable for forming this detergent additive. The alkyl substituents may contain some residual unsaturation, but in general, are substantially saturated alkyl groups.

In approaches or embodiments, representative amine reactants suitable to form the Mannich detergent herein include, but are not limited to, alkylene polyamines having at least one suitably reactive primary or secondary amino group in the molecule. Other substituents such as hydroxyl, cyano, amido, etc., can be present in the polyamine. In a one embodiment, the alkylene polyamine is a polyethylene polyamine. Suitable alkylene polyamine reactants include ethylenediamine, diethylenetriamine, triethylenetetramine, tetraethylene pentamine and mixtures of such amines having nitrogen contents corresponding to alkylene polyamines of the formula $H_2N\text{-}(A\text{-}NH\text{—})_nH$, where A in this formula is divalent ethylene or propylene and n is an integer of from 1 to 10, preferably 1 to 4. The alkylene polyamines may be obtained by the reaction of ammonia and dihalo alkanes, such as dichloro alkanes.

The amine may also be an aliphatic diamine having one primary or secondary amino group and at least one tertiary amino group in the molecule. Examples of suitable polyamines include N,N,N",N"-tetraalkyldialkylenetriamines (two terminal tertiary amino groups and one central secondary amino group), N,N,N',N"-tetraalkyltrialkylene tetramines (one terminal tertiary amino group, two internal tertiary amino groups and one terminal primary amino group), N,N,N',N",N'"-pentaalkyltrialkylenetetramines (one terminal tertiary amino group, two internal tertiary amino groups and one terminal secondary amino group), N,N'-dialkylamine, N,N-dihydroxyalkyl-alpha-, omega-alkylenediamines (one terminal tertiary amino group and one terminal primary amino group), N,N,N'-trihydroxyalkyl-alpha, omega-alkylenediamines (one terminal tertiary amino group and one terminal secondary amino group), tris(dialkylaminoalkyl) aminoalkylmethanes (three terminal tertiary amino groups and one terminal primary amino group), and similar compounds, wherein the alkyl groups are the same or different and typically contain no more than about 12 carbon atoms each, and which preferably contain from 1 to 4 carbon atoms each. Most preferably these alkyl groups are methyl and/or ethyl groups. Preferred polyamine reactants are N,N-dialkyl-alpha, omega-alkylene diamine, such as those having from 3 to about 6 carbon atoms in the alkylene group and from 1 to about 12 carbon atoms in each of the alkyl groups, which most preferably are the same but which can be different. Exemplary amines may include N,N-dimethyl-1,3-propanediamine and/or N-methyl piperazine.

Examples of polyamines having one reactive primary or secondary amino group that can participate in the Mannich condensation reaction, and at least one sterically hindered amino group that cannot participate directly in the Mannich condensation reaction to any appreciable extent include N-(tert-butyl)-1,3-propanediamine, N-neopentyl-1,3-propane diamine-, N-(tert-butyl)-1-methyl-1,2-ethanediamine, N-(tert-butyl)-1-methyl-1,3-propane diamine, and 3,5-di (tert-butyl)aminoethylpiperazine.

In approaches or embodiments, representative aldehydes for use in the preparation of the Mannich detergents herein include the aliphatic aldehydes such as formaldehyde, acetaldehyde, propionaldehyde, butyraldehyde, valeraldehyde, caproaldehyde, heptaldehyde, stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. Most preferred is formaldehyde or formalin.

The condensation reaction among the alkylphenol, the specified amine(s) and the aldehyde may be conducted at a temperature typically in the range of about 40° C. to about 200° C. The reaction can be conducted in bulk (no diluent or solvent) or in a solvent or diluent. Water is evolved and can be removed by azeotropic distillation during the course of the reaction. Typically, the Mannich reaction products are formed by reacting the alkyl-substituted hydroxyaromatic compound, the amine and aldehyde in the molar ratio of 1.0:0.5-2.0:1.0-3.0, respectively. Suitable Mannich base detergents include those detergents taught in U.S. Pat. Nos. 4,231,759; 5,514,190; 5,634,951; 5,697,988; 5,725,612; and 5,876,468, the disclosures of which are incorporated herein by reference.

In other approaches or embodiments, suitable Mannich detergents for the fuel additives herein may have a structure of Formula I below:

(Formula I)

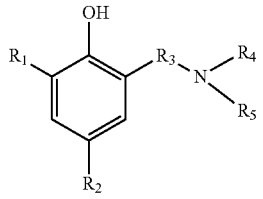

wherein one of $R_1$ and $R_2$ of Formula I is hydrogen or a C1 to C4 alkyl group, the other of $R_1$ and $R_2$ is a hydrocarbyl group having a number average molecular weight of about 500 to about 3000, $R_3$ of Formula I is a C1 to C4 alkylene or alkenyl linking group, and $R_4$ and $R_5$ of Formula I are, independently, hydrogen, a C1 to C12 alkyl group, or a mono or di(C1 to C4)alkyl amino C1-C12 alkyl group. In one aspect, $R_1$ of Formula I is hydrogen or a C1 to C4 alkyl group, $R_2$ of Formula I is a hydrocarbyl group having a number average molecular weight of about 500 to about 3000 (or about 500 to about 2100, or about 500 to about 1800, or about 500 to about 1500). In another aspect, $R_1$ of Formula I is hydrogen or a C1 to C4 alkyl group, and $R_2$ of Formula I is a polyisobutenyl group having a number average molecular weight of about 500 to about 1500.

In other approaches or embodiments, the detergent may include at least two Mannich detergent additives. In this optional embodiment, a first Mannich detergent additive may have the structure of Formula I with $R_4$ and $R_5$ each being a C1 to C12 alkyl group (preferably a C3 to C6 alkyl group) and a second Mannich detergent additive may have the structure of Formula I with $R_4$ being hydrogen and $R_5$ being the di(C1 to C4)alkyl amino C1-C12 alkyl group. More specifically, the first Mannich detergent additive may have the structure of Formula Ia and the second Mannich detergent additive have the structure of Formula Ib:

(Formula Ia)

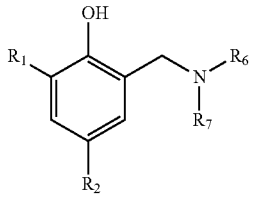

(Formula Ib)

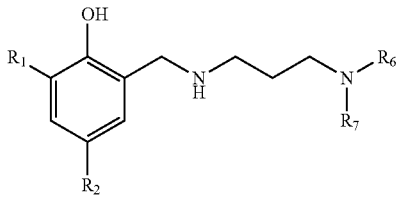

wherein each $R_1$ is independently hydrogen or a C1 to C4 alkyl group, each $R_2$ is independently a hydrocarbyl group having a number average molecular weight of about 500 to about 3000 (or other ranges as discussed above), and $R_6$ and $R_7$ are, independently, a C1 to C12 alkyl group (preferably, a C1 to C6 alkyl group, or more preferably, a C1 to C4 alkyl group).

If the detergent includes the first and second Mannich detergent additives, then the detergent may include about 10 to about 30 weight percent of the first Mannich detergent additive and about 10 to about 30 weight percent of the second Mannich detergent additive. In other approaches and if the detergent includes the first and second Mannich detergent additives, then a weight ratio of the first Mannich detergent additive to the second Mannich detergent additive is about 1:1 to about 2:1.

A fuel additive or additive package may include about 20 to about 60 weight percent of the above-described one or more Mannich detergents, about 22 to about 45 weight percent of the one or more Mannich detergents, or about 25 to about 40 weight percent of the one or more Mannich detergent (based on the total weight of the active Mannich detergent in the fuel additive). When blended into a gasoline fuel, the fuel composition may include about 10 ppmw to about 300 ppmw of the above-described Mannich detergent, about 25 ppmw to about 155 ppmw, about 45 ppmw to about 125 ppmw, or about 55 ppmw to about 125 ppmw of the Mannich detergent in the fuel composition (active Mannich detergent treat rates). In some embodiments, the fuel additives herein includes a single type of Mannich detergents or, as discussed above, the fuel additives herein may include at least two Mannich detergents.

Mannich-Based Quaternary Ammonium Salt Detergent

The Mannich-based quaternary ammonium salt detergent additives herein are derived from Mannich reaction products having at least a terminal tertiary amine and then the tertiary amine is quaternized with a suitable quaternizing agent. For instance, the one or more Mannich-based quaternary ammonium salt detergent additives herein include (i) a Mannich reaction product or derivative thereof having at least one tertiary amino group and prepared from a hydrocarbyl-substituted phenol, cresol, or derivative thereof, an aldehyde, and a hydrocarbyl amine or polyamine providing the tertiary amino group and reacted with (ii) a quaternizing agent selected from the group consisting of a carboxylic or polycarboxylic acid, ester, amide, or salt thereof or halogen substituted derivative thereof.

In one embodiment, an exemplary Mannich-based quaternary ammonium salt compound has the structure of Formula II (Formula II)

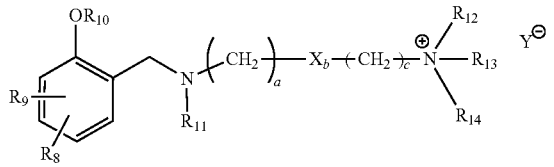

wherein $R_8$ is a hydrocarbyl radical where a number average molecular weight of the hydrocarbyl is about 200 to about 5,000; $R_9$ is hydrogen or a $C_1$-$C_6$ alkyl group; $R_{10}$ is hydrogen or, together with $R_{11}$, a —C(O)— group or a —$CH_2$— group forming a ring structure with the nitrogen atom closest to the aromatic ring; $R_{11}$ is one of hydrogen, $C_1$-$C_6$ alkyl, —$(CH_2)_a$—$NR_5R_6$, —$(CH_2)_a$-Aryl$(R_1)(R_2)(OR_3)$, or together with $R_{10}$, a —C(O)— group or a —$CH_2$— group forming a ring structure with the nitrogen atom closest to the aromatic ring; $R_{12}$, is $C_1$-$C_6$ alkyl or, together with $Y^{\ominus}$, forms a C1-C6 alkyl substituted —C(O)$O^{\ominus}$; $R_{13}$ and $R_{14}$, independently, are $C_1$-$C_6$ alkyl; a is an integer from 1 to 10, b is an integer selected from either 0 or 1, and c is an integer from 0 to 10; X is oxygen or nitrogen; and $Y^{\ominus}$ is an anionic group having a structure $R_{15}C(O)O^{\ominus}$ wherein $R_{15}$ is one of (i) together with $R_5$ a C1-C6 alkyl group or (ii) an alkyl, an aryl, or a —C(O)O—$R_2$ group. Preferably, $R_{10}$ is hydrogen, a is 1 to 4 (most preferably 3), b is 0, c is 0, and each of $R_{12}$, $R_{13}$, and $R_{14}$ are a C1 to C4 (preferably a C1) alkyl group.

Mannich reaction products are first obtained from hydrocarbyl-substituted hydroxyaromatic compounds. Representative hydrocarbyl-substituted hydroxyaromatic compounds suitable for forming the Mannich-based quaternary salt additives herein may include those of Formula III (Formula III)

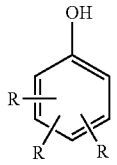

where each R is independently hydrogen, a C1-C4 alkyl group, or a hydrocarbyl substituent having a number average molecular weight (Mn) in the range of about 300 to about 5,000 (in other approaches, about 300 to about 2,000 and particularly about 500 to about 1,500) as determined gel permeation chromatography (GPC). In some approaches, at least one R is hydrogen and one R is a hydrocarbyl substituent as defined above.

In some approaches, suitable hydrocarbyl substituents may include polyolefin polymers or copolymers, such as polypropylene, polybutene, polyisobutylene, and ethylene alpha-olefin copolymers. Examples include polymers or copolymers of butylene and/or isobutylene and/or propylene, and one or more mono-olefinic co-monomers (e.g., ethylene, 1-pentene, 1-hexene, 1-octene, 1-decene, and the like) where the copolymer may include at least 50% by weight, of butylene and/or isobutylene and/or propylene units. The co-monomers polymerized with propylene or such butenes may be aliphatic and can also contain non-aliphatic groups, e.g., styrene, o-methylstyrene, p-methylstyrene, divinyl benzene and the like. Polyolefin polymer hydrocarbyl substituents can have at least 20%, in some cases at least 50%, and in other cases at least 70% of their olefin double bonds at a terminal position on the carbon chain as the highly reactive vinylidene isomer.

Polybutylene is one useful hydrocarbyl substituent for the hydroxyaromatic compound. Polybutylene substituents may include 1-butene or isobutene, as well as polymers made from mixtures of two or all three of 1-butene, 2-butene and isobutene. Polyisobutylene is another suitable hydrocarbyl substituent for the hydroxyaromatic compounds herein. High reactivity polyisobutenes having relatively high proportions of polymer molecules with a terminal vinylidene group, such as, at least 20% of the total terminal olefinic double bonds in the polyisobutene comprise an alkylvinylidene isomer, in some cases, at least 50% and, in other cases, at least 70%, formed by methods such as described, for example, in U.S. Pat. No. 4,152,499, are suitable polyalkenes for use in forming the hydrocarbyl substituted hydroxyaromatic reactant. Also suitable for use in forming the long chain substituted hydroxyaromatic reactants herein are ethylene alpha-olefin copolymers having a number average molecular weight of 500 to 3,000, wherein at least about 30% of the polymer's chains contain terminal ethylidene unsaturation.

In one embodiment, the hydrocarbyl-substituted hydroxyaromatic compound has one R that is H, one R that is a C1-C4 alkyl group (in some approaches, a methyl group), and one R is a hydrocarbyl substituent having an average molecular weight in the range of about 300 to about 2,000, such as a polyisobutylene substituent. In other embodiments, the hydrocarbyl-substituted hydroxyaromatic compound can be obtained by alkylating o-cresol with a high molecular weight hydrocarbyl polymer, such as a hydrocarbyl polymer having a number average molecular weight between about 300 to about 2,000, to provide an alkyl-substituted cresol. In some instances, o-cresol is alkylated with polyisobutylene having a number average molecular weight between about 300 to about 2,000 to provide a polyisobutylene-substituted cresol. In yet other instances, o-cresol is alkylated with polyisobutylene (PIB) having a number average molecular weight between about 500 to about 1,500 to provide a polyisobutylene-substituted cresol (PIB-cresol).

In yet other approaches, the hydrocarbyl-substituted hydroxyaromatic compound can be obtained by alkylating o-phenol with a high molecular weight hydrocarbyl polymer, such as a hydrocarbyl polymer group having a number average molecular weight between about 300 to about 2,000, to provide an alkyl-substituted phenol. In one embodiment, o-cresol is alkylated with polybutylene having a number average molecular weight between about 500 to about 1,500 to provide a polybutylene-substituted cresol.

Alkylation of the hydroxyaromatic compound may be performed in the presence of an alkylating catalyst, such as a Lewis acid catalyst (e.g., $BF_3$ or $AlCl_3$), at a temperature of about 30 to about 200° C. For a polyolefin used as the hydrocarbyl substituent, it may have a polydispersity (Mw/Mn) of about 1 to about 4, in other cases, from about 1 to about 2, as determined by GPC. Suitable methods of alkylating the hydroxyaromatic compounds are described in GB 1,159,368 or U.S. Pat. Nos. 4,238,628; 5,300,701 and 5,876,468, which are all incorporated herein by references in their entirety.

Representative aldehyde sources for use in the preparation of the Mannich base intermediate products herein include aliphatic aldehydes, aromatic aldehydes, and/or heterocyclic aldehydes. Suitable aliphatic aldehydes may include C1 to C6 aldehydes, such as formaldehyde, acetaldehyde, propionaldehyde, butyraldehyde, valeraldehyde, and hexanal aldehyde. Exemplary aromatic aldehydes may include benzaldehyde and salicylaldehyde, and exemplary heterocyclic aldehydes may include furfural and thiophene aldehyde. In some instances, formaldehyde-producing reagents such as paraformaldehyde, or aqueous formaldehyde solutions such as formalin may also be used in forming the Mannich-based tertiary amines herein. Most preferred is formaldehyde and/or formalin.

Suitable hydrocarbyl polyamines for the Mannich products herein include those with at least one primary amine and at least one terminal tertiary amine. In one approach, the hydrocarbyl polyamine has the structure $R_9R_{10}N$—$[CH_2]_a$—$X_b$—$[CH_2]_c$—$NR_9R_{10}$ wherein $R_9$ and $R_{10}$ are independently a hydrogen or a C1 to C6 alkyl group with one $R_9$ and $R_{10}$ pair forming a tertiary amine, X being an oxygen or a nitrogen, a is an integer from 1 to 10, b is an integer of 0 or 1, and c is an integer from 0 to 10. Suitable exemplary tertiary amine for forming the fuel additives herein may be selected from 3-(2-(dimethylamino)ethoxy) propylamine, N,N-dimethyl dipropylene triamine, dimethylamino propylamine, and/or mixtures thereof.

In one embodiment, the Mannich-based quaternary ammonium salt detergents herein are obtained from a tertiary amine having the structure of Formula IV (Formula IV)

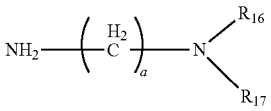

where a is an integer from 1 to 10 (preferably, an integer of 2 to 4) and $R_{16}$ and $R_{17}$ are, independently, a C1 to C10 alkyl or hydrocarbyl group (preferably, a C1 to C4 alkyl groups). In other embodiments, the Mannich-based quaternary ammonium salt detergents herein are obtained from a tertiary amine having the structure of Formula V (Formula V)

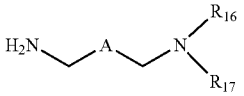

where A is a hydrocarbyl linker with 1 to 10 total carbon units and optionally including one or more carbon units thereof independently replaced with a bivalent moiety selected from the group consisting of —O—, —N(R')—, —C(O)—, —C(O)O—, and —C(O)NR' and $R_{16}$ and $R_{17}$ are, independently, alkyl groups containing 1 to 8 carbon atoms, and R' is independently a hydrogen or a group selected from C1-C6 aliphatic, phenyl, or alkylphenyl. In one approach, the select amines of Formula IV or V are at least diamines or triamines having a terminal primary amino group on one end for the Mannich reaction and a terminal tertiary amine on the other end for reaction with the quaternizing agent. In other optional approaches, A includes 1 to 6 carbon units with one carbon unit thereof optionally replaced with a —O— or a —NH— group. The hydrocarbyl linker A may optionally have 1 to 4 carbon units replaced with the bivalent moiety described above, which is preferably a —O— or a —NH— group. In yet other optional approaches, 1 to 2 carbon units of the hydrocarbyl linker A and, in yet further optional approaches, 1 carbon unit of the hydrocarbyl linker A is replaced with the bivalent moiety described herein. As appreciated, the remainder of the hydrocarbyl linker A in these optional approaches is preferably a carbon atom. In such optional approaches, the number of carbon atoms on either side of the replaced bivalent moiety need not be equal meaning the hydrocarbyl chain between the terminal primary amino group and the terminal tertiary amino group need not be symmetrical relative to the replaced bivalent moiety.

To prepare the Mannich-based quaternary ammonium salt detergents herein, a Mannich reaction of the selected polyamine, the hydrocarbyl-substituted hydroxyaromatic compound, and the aldehyde as described above is first conducted at a temperature about 30° C. to about 200° C. The reaction can be conducted in bulk (no diluent or solvent) or in a solvent or diluent. Water is evolved and can be removed by azeotropic distillation during the course of the reaction. For instance the temperature is typically increased, such as to about 150° C., when removing the water that is evolved in the reaction. Typical reaction times range from about 3 to about 4 hours, although longer or shorter times can be used as necessary or as desired.

An exemplary Mannich reaction can start with the addition of a hydrocarbyl-substituted hydroxyaromatic component to the reaction vessel together with a suitable solvent to obtain a blend. The blend is mixed under an inert atmosphere. Next, the polyamine is added when the blend is homogeneous and is at a moderate temperature, such as about 40 to about 45° C. Then, the selected aldehyde, such as formaldehyde, is added. The temperature rises, such as to about 45 to about 50° C., and the temperature may be further increased to less than 100° C., such as about 80° C., and maintained at such temperature for about 30 minutes to about 60 minutes. Distillation can then be conducted using a Dean Stark trap or equivalent apparatus and the temperature is set to about 130 to about 150° C., and it should be appreciated that distillation may start after a period of time to allow the reaction mixture to reach about 95 to 105° C. The temperature is maintained at the selected elevated temperature for sufficient time, which may be about an additional 2 hours to about 2.5 hours to produce the Mannich-based tertiary amine. Other suitable Mannich reaction schemes may be used as well to prepare the intermediate Mannich-based tertiary amine.

The so-formed Mannich-based tertiary amine is then alkylated or quaternized with a suitable alkylating or quaternizing agent. In one embodiment, a suitable alkylating or quaternizing agent is a hydrocarbyl carboxylate, such as an alkyl carboxylate. In such approaches, the quaternizing agent may be an alkyl carboxylate selected form alkyl oxalate, alkyl salicylate, and combinations thereof. In one aspect, the alkyl group of the alkyl carboxylate may include 1 to 6 carbon atoms, and is preferably methyl groups. A particularly useful alkyl carboxylate alkylation or quaternization may be dimethyl oxalate or methyl salicylate. The amount of alkyl carboxylate relative to the amount of tertiary amine reactant may range from a molar ratio of about 10:1 to about 1:10, e.g., about 3:1 to about 1:3.

For alkylation with alkyl carboxylates, it may be desirable that the corresponding acid of the carboxylate have a pKa of less than 4.2. For example, the corresponding acid of the carboxylate may have a pKa of less than 3.8, such as less than 3.5, with a pKa of less than 3.1 being particularly desirable. Examples of suitable carboxylates may include, but not limited to, maleate, citrate, fumarate, phthalate, 1,2,4-benzenetricarboxylate, 1,2,4,5-benzenetetra carboxylate, nitrobenzoate, nicotinate, oxalate, aminoacetate, and salicylate. As noted above, preferred carboxylates include oxalate, salicylate, and combinations thereof.

The Mannich-based quaternary ammonium salt of the present disclosure may have the structure of Formula II above and may be derived from the reaction of (i) the Mannich reaction product or derivative thereof having at least one tertiary amino group and prepared from a hydrocarbyl-substituted phenol, cresol, or derivative thereof, an aldehyde, and a hydrocarbyl polyamine providing the tertiary amino group and reacted with (ii) the quaternizing agent as discussed above and selected from the group consisting of a carboxylic or polycarboxylic acid, ester, amide, or salt thereof or halogen substituted derivative thereof.

In one embodiment or approach, the quaternary ammonium salt fuel additive has the structure of Formula II wherein $R_8$ is a hydrocarbyl radical derived from a 500 to 1,500 number average molecular weight polyisobutylene polymer or oligomer, $R_9$ is hydrogen or a methyl group, $R_{10}$ and $R_{11}$ are each hydrogen; a is an integer from 1 to 4, and b and c are each 0. In some approaches when the quaternizing agent is an alkyl carboxylate, such as dimethyl oxylate or methyl salicylate, $Y^{\ominus}$ of the Mannich quaternary ammonium salt is an anionic group having the structure $R_{15}C(O)O^{\ominus}$ with $R_{15}$ being the alkyl, the aryl, or the —C(O)O—$R_2$ group. An exemplary structure of this Mannich-based quaternary ammonium salt embodiment is shown below in Formula IIa:

(Formula IIa)

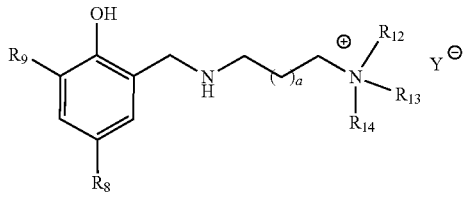

In embodiments or approaches, herein, the detergent includes about 2 to about 50 weight percent of the Mannich-based quaternary ammonium salt detergent additives discussed above, and more preferably, the detergent includes about 2 to about 20 weight percent of the one or more quaternary ammonium salt detergent additives, or more preferably about 10 to about 20 weight percent (based on the total weight of the Mannich detergents and the Mannich-based quaternary salt detergents). A fuel additive or additive package may include about 1 to about 50 weight percent of the above-described Mannich-based quaternary ammonium detergent additive, about 20 to about 50 weight percent of the Mannich-based quaternary ammonium detergent, or about 25 to about 40 weight percent of the Mannich-based quaternary ammonium detergent (based on the total weight of the active Mannich-based quaternary ammonium detergent in the fuel additive). When blended into a gasoline fuel, the fuel composition may include about 1 ppmw to about 200 ppmw of the above-described Mannich-based quaternary ammonium detergent, about 4 ppmw to about 100 ppmw, or about 7 ppmw to about 50 ppmw of the Mannich-based quaternary ammonium detergent in the fuel composition (active quaternary detergent treat rates).

Alkoxylated Alcohol

The fuel additives or fuels of the present disclosure may also include one or more optional alkoxylated alcohols. The alkoxylated alcohol is preferably a polyether prepared by reacting an long chain alkyl alcohol or alkylphenol with an alkylene oxide. By one approach, the alkoxylated alcohol may be one or more hydrocarbyl-terminated or hydrocarbyl-capped poly(oxyalkylene) polymers. The hydrocarbyl moieties thereof may be aryl or aliphatic groups, and preferably, aliphatic chains that are linear, branched or cyclic, and most preferably are linear aliphatic chains. In one approach, the alkoxylated alcohols may have the structure of Formula VIa, VIb, and/or VIc below:

(Formula VIa)

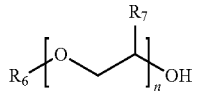

-continued (Formula VIb)

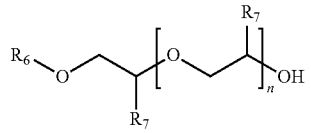

(Formula VIc)

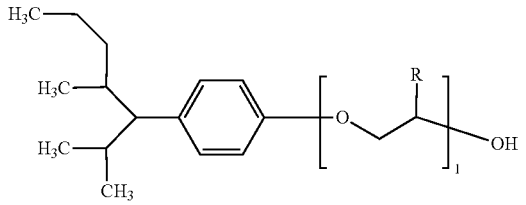

wherein $R_6$ of the Formula VI structures above is an aryl group or a linear, branched, or cyclic aliphatic group and preferably having 5 to 50 carbons (or 5 to 30 carbons) or may be a —$C_mH_{2m+1}$ group where m is an integer of 12 or more, $R_7$ of the Formula VI structures above is a C1 to C4 alkyl group, and n is an integer from 5 to 100 (or as further discussed below).

In some approaches, suitable alkoxylated alcohols are derived from lower alkylene oxides selected from the group consisting of ethylene oxide, propylene oxide, butylene oxide, copolymers thereof, and combinations thereof. Preferably, the lower alkylene oxides are propylene oxide or butylene oxide or copolymers of ethylene oxide, propylene oxide, and butylene oxide (as well as any combinations thereof). In another approach, the alkylene oxides are propylene oxide. Any copolymers of such alkylene oxides may be random or block copolymers. In one approach, the alkoxylated alcohols may be terminated or capped with an aryl, alkyl, or hydrocarbyl group and may include one or more aryl or linear, branched, or cyclic aliphatic C5 to C30 terminated alkoxylated alcohols, and in other approaches, a C16 to C18 (or blend thereof) terminated alkoxylated alcohol having 5 to 100, 10 to 80, 20 to 50, or 22 to 32 repeating units of the alkylene oxide therein (that is, n integer of the formula above). In some approaches, the alkoxylated alcohols may have a weight average molecular weight of about 1300 to about 2600 and, in other approaches, about 1600 to about 2200.

In some approaches, the aliphatic hydrocarbyl terminated alkoxylated alcohols may include about 20 to about 70 weight percent (in another approach, about 30 to about 50 weight percent) of an aliphatic C16 alkoxylated alcohol having 24 to 32 repeating units of alkoxylene oxide and/or may include about 80 to about 30 weight percent (in another approach, about 50 to about 70 weight percent) of an aliphatic C18 alkoxylated alcohol having 24 to 32 repeating units of alkoxylene oxide. In other approaches, the fuel additives herein, if including an alkoxylated alcohol, may also have about 8 percent or less (in other approaches, about 6 percent or less, and in yet other approaches, about 4 percent or less) of C20 or greater alkoxylated alcohols and/or about 4 weight percent or less (in or other approaches about 2 weight percent or less, and in yet other approaches, about 1 percent or less) of C14 or lower alkoxylated alcohols.

The aryl or hydrocarbyl-capped poly(oxyalkylene) alcohols may be produced by the addition of lower alkylene oxides, such as ethylene oxide, propylene oxide, or the butylene oxides, to a desired hydroxy compound R—OH (that is, a starter alcohol) under polymerization conditions, wherein R is the aryl or hydrocarbyl group having either 5 to 30 carbons or other chain length as noted above and which caps the poly(oxyalkylene) chain. The alkoxylated alcohols can be prepared by any starter alcohol that provides the desired polyol distribution. By one approach, the alkoxylated alcohol can be prepared by reacting a saturated linear or branched alcohol of the desired hydrocarbon size with the selected alkylene oxide and a double metal or basic catalyst. In one approach, the alkoxylated alcohol may be nonylphenol alkyoxylated alcohol such as nonylphenol propoxylated alcohol.

In other approaches, in the polymerization reaction a single type of alkylene oxide may be employed, e.g., propylene oxide, in which case the product is a homopolymer, e.g., a poly(oxyalkylene) propanol. However, copolymers are equally satisfactory and random or block copolymers are readily prepared by contacting the hydroxyl-containing compound with a mixture of alkylene oxides, such as a mixture of ethylene, propylene, and/or butylene oxides. Random polymers are more easily prepared when the reactivities of the oxides are relatively equal. In certain cases, when ethylene oxides is copolymerized with other oxides, the higher reaction rate of ethylene oxide makes the preparation of random copolymers difficult. In either case, block copolymers can be prepared. Block copolymers are prepared by contacting the hydroxyl-containing compound with first one alkylene oxide, then the others in any order, or repetitively, under polymerization conditions. In one example, a particular block copolymer may be represented by a polymer prepared by polymerizing propylene oxide on a suitable monohydroxy compound to form a poly(oxypropylene) alcohol and then polymerizing butylene oxide on the poly (oxyalkylene) alcohol.

A fuel additive or fuel herein, when included, may include about 5 to about 30 weight percent of the alkoxylated alcohol, about 8 to about 20 weight percent of the alkoxylated alcohol, or about 10 to about 15 weight percent of the alkoxylated alcohol (based on the active alkoxylated alcohol in the fuel additive). When blended into a gasoline fuel, the fuel may include about 2 ppmw to about 150 ppmw of the active alkoxylated alcohol, about 5 to about 150 ppmw, about 8 ppmw to about 50 ppmw, or about 15 ppmw to about 40 ppmw of the alkoxylated alcohol in the fuel.

In other approaches, the fuel additive package or fuel thereof also has a certain weight ratio of the alkoxylated alcohol to the Mannich detergent of about 1.0 or less (i.e., about 1.0:1 or less), about 0.8 or less (i.e., 0.8:1 or less), about 0.6 or less, about 0.5 or less, about 0.4 or less, or about 0.3 or less, and about 0.1 or more (i.e., 0.1:1 or more), about 0.2 or more, or about 0.3 or more.

Fuel Additive:

When formulating the fuel compositions of this application, the above described additives (including at least the one or more Mannich detergents and the one or more Mannich-based quaternary ammonium salt detergents) may be employed in amounts sufficient to reduce or inhibit deposit formation in a fuel system, a combustion chamber of an engine and/or crankcase, and/or within fuel injectors and within a gasoline direction injection engine and/or a port fuel injection engine. Such additives may also be provided in amounts to improve injector performance as described herein. In some aspects, the fuel additive or fuel additive package herein may include at least the above described Mannich detergent, the Mannich-based quaternary ammonium salt detergent, and the optional alkoxylated alcohol. The fuel additives herein may also include other optional additives as needed for a particular application and may include as needed one or more of a demulsifier, a corrosion inhibitor, an antiwear additive, an antioxidant, a metal deactivator, an antistatic additive, a dehazer, an antiknock additive, a lubricity additive, and/or a combustion improver.

In some approaches or embodiments, the fuel additive or additive package herein may include about 20 to about 60 weight percent of the one or more Mannich detergent additives (preferably, about 25 to about 50 weight percent, and most preferably, about 25 to about 40 weight percent) and about 1 to about 50 weight percent of the one or more Mannich-based quaternary ammonium salt detergent additives (preferably, about 3 to about 10 and most preferably, about 4 to about 8 weight percent). In other approaches, the fuel additive or additive package may also include about 5 to about 30 weight percent of the alkoxylated alcohol (preferably, about 10 to about 25, and most preferably, about 12 to about 20 weight percent). Other ranges of the Mannich detergent additives, the Mannich-based quaternary ammonium salt detergents, and the optional alkoxylated alcohol may also be used in the fuel additive, the additive package, or the fuel as described above in this disclosure.

In other approaches, a gasoline fuel composition may include about 40 to about 750 ppmw of the fuel additive or the additive package herein, in other approaches, about 60 to about 380 ppmw, or about 135 to about 310 ppmw of the above noted fuel additive package and which provides about 15 to about 300 ppmw of the Mannich detergent and about 1 to about 200 ppmw of the Mannich-based quaternary ammonium salt detergent to the fuel (or other ranges as noted above). In other embodiments, the fuel may also include about 5 to about 150 ppmw of the optional alkoxylated alcohol (or other ranges as noted above). It will also be appreciated that any endpoint between the above described ranges are also suitable range amounts as needed for a particular application. The above-described amounts reflects additives on an active ingredient basis, which means the additives noted above excludes the weight of (i) unreacted components associated with and remaining in the product as produced and used, and (ii) solvent(s), if any, used in the manufacture of the product either during or after its formation.

In other approaches and as discussed above, the fuel additive package or fuel thereof also has a certain weight ratio of the alkoxylated alcohol to the one or more Mannich detergents of about 1.0 or less (i.e., about 1.0:1 or less), about 0.8 or less (i.e., 0.8:1 or less), about 0.6 or less, about 0.5 or less, about 0.4 or less, or about 0.3 or less, and about 0.1 or more (i.e., 0.1:1 or more), about 0.2 or more, or about 0.3 or more.

In yet other approaches, the fuel additive package or fuel thereof may also have a weight ratio of the one or more Mannich detergents to the one or more Mannich-based quaternary ammonium salt detergents of about 1:1 to about 6:1, or about 1:1 to about 5.5:1 or about 1:1 to about 3:1 (wherein the weight ratios are active Mannich detergent to the active Mannich-based quaternary ammonium salt detergent). As shown in the Examples below, such weight ratios achieve a surprising synergy of the detergent additives in both FPI and GDI engine performance.

Other Additives

One or more optional compounds may be present in the fuel compositions of the disclosed embodiments. For example, the fuels may contain conventional quantities of cetane improvers, octane improvers, corrosion inhibitors, cold flow improvers (CFPP additive), pour point depressants, solvents, demulsifiers, lubricity additives, friction modifiers, amine stabilizers, combustion improvers, detergents, dispersants, antioxidants, heat stabilizers, conductivity improvers, metal deactivators, marker dyes, organic nitrate ignition accelerators, cyclomatic manganese tricarbonyl compounds, carrier fluids, and the like. In some aspects, the compositions described herein may contain about 10 weight percent or less, or in other aspects, about 5 weight percent or less, based on the total weight of the additive concentrate, of one or more of the above optional additives. Similarly, the fuels may contain suitable amounts of conventional fuel blending components such as methanol, ethanol, dialkyl ethers, 2-ethylhexanol, and the like.

In some aspects of the disclosed embodiments, organic nitrate ignition accelerators that include aliphatic or cycloaliphatic nitrates in which the aliphatic or cycloaliphatic group is saturated, and that contain up to about 12 carbons may be used. Examples of organic nitrate ignition accelerators that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, and the like. Mixtures of such materials may also be used.

Examples of suitable optional metal deactivators useful in the compositions of the present application are disclosed in U.S. Pat. No. 4,482,357, the disclosure of which is herein incorporated by reference in its entirety. Such metal deactivators include, for example, salicylidene-o-aminophenol, disalicylidene ethylenediamine, disalicylidene propylenediamine, and N,N'-disalicylidene-1,2-diaminopropane.

Suitable optional cyclomatic manganese tricarbonyl compounds which may be employed in the compositions of the present application include, for example, cyclopentadienyl manganese tricarbonyl, methylcyclopentadienyl manganese tricarbonyl, indenyl manganese tricarbonyl, and ethylcyclopentadienyl manganese tricarbonyl. Yet other examples of suitable cyclomatic manganese tricarbonyl compounds are disclosed in U.S. Pat. Nos. 5,575,823 and 3,015,668 both of which disclosures are herein incorporated by reference in their entirety.

Other commercially available detergents may be used in combination with the reaction products described herein. Such detergents include but are not limited to succinimides, Mannich base detergents, PIB amine, quaternary ammonium detergents, bis-aminotriazole detergents as generally described in U.S. patent application Ser. No. 13/450,638, and a reaction product of a hydrocarbyl substituted dicarboxylic acid, or anhydride and an aminoguanidine, wherein the reaction product has less than one equivalent of amino triazole group per molecule as generally described in U.S. patent application Ser. Nos. 13/240,233 and 13/454,697.

The additives of the present application and optional additives used in formulating the fuels of this invention may be blended into the base fuel individually or in various sub-combinations. In some embodiments, the additive components of the present application may be blended into the fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

Fuels

The fuels of the present application may be applicable to the operation of diesel, jet, or gasoline engines, and preferably, spark-ignition or gasoline engines. The engines may include both stationary engines (e.g., engines used in electrical power generation installations, in pumping stations, etc.) and ambulatory engines (e.g., engines used as prime movers in automobiles, trucks, road-grading equipment, military vehicles, etc.). For example, the fuels may include any and all middle distillate fuels, diesel fuels, biorenewable fuels, biodiesel fuel, fatty acid alkyl ester, gas-to-liquid (GTL) fuels, gasoline, jet fuel, alcohols, ethers, kerosene, low sulfur fuels, synthetic fuels, such as Fischer-Tropsch fuels, liquid petroleum gas, bunker oils, coal to liquid (CTL) fuels, biomass to liquid (BTL) fuels, high asphaltene fuels, fuels derived from coal (natural, cleaned, and petcoke), genetically engineered biofuels and crops and extracts therefrom, and natural gas. Preferably, the additives herein are used in spark-ignition fuels or gasoline. "Biorenewable fuels" as used herein is understood to mean any fuel which is derived from resources other than petroleum. Such resources include, but are not limited to, corn, maize, soybeans and other crops; grasses, such as switchgrass, miscanthus, and hybrid grasses; algae, seaweed, vegetable oils; natural fats; and mixtures thereof. In an aspect, the biorenewable fuel can comprise monohydroxy alcohols, such as those comprising from 1 to about 5 carbon atoms. Non-limiting examples of suitable monohydroxy alcohols include methanol, ethanol, propanol, n-butanol, isobutanol, t-butyl alcohol, amyl alcohol, and isoamyl alcohol. Preferred fuels include diesel fuels.

Accordingly, aspects of the present application are directed to methods of or the use of the noted fuel additive package for controlling or reducing fuel injector deposits, controlling or reducing intake valve deposits, controlling or reducing combustion chamber deposits, and/or controlling or reducing intake valve sticking in one of port-injection engines, direct-injection engines, and preferably both engine types. In some approaches, the fuel additives and fuels herein are configured to reduces deposits when sprayed from an injector in droplets of about 10 to about 30 microns, when sprayed from an injector in droplets of about 120 to about 200 microns, or both. As such, the fuel additives and fuels herein surprisingly provide improved engine performance as defined herein in both port fuel injected engines (PFI) as well as gasoline direct injection engines (GDI). In some aspects, the method may also comprise mixing into the fuel at least one of the optional additional ingredients described above. The improved engine performance may be evaluated pursuant to the test protocols of ASTM D6201 or by the methods as set forth in the following two SAE publications: Smith, S. and Imoehl, W., "Measurement and Control of Fuel Injector Deposits in Direct Injection Gasoline Vehicles," SAE Technical Paper 2013-01-2616, 2013, doi: 10.4271/2013-01-2616 and/or Shanahan, C., Smith, S., and Sears, B., "A General Method for Fouling Injectors in Gasoline Direct Injection Vehicles and the Effects of Deposits on Vehicle Performance," SAE Int. J. Fuels Lubr. 10(3): 2017, doi:10.4271/2017-01-2298, both of which are incorporated herein by reference. Intake valve sticking may be evaluated using the test protocols at Southwest Research Institute (SWRI, San Antonio Texas) or similar test house.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %", unless expressly stated otherwise, means the percentage the recited component represents to the weight of the entire composition. All percent numbers herein, unless specified otherwise, is weight percent.

The term "alkyl" as employed herein refers to straight, branched, cyclic, and/or substituted saturated chain moieties from about 1 to about 200 carbon atoms. The term "alkenyl" as employed herein refers to straight, branched, cyclic, and/or substituted unsaturated chain moieties from about 3 to about 30 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the molecular weight is determined by gel permeation chromatography (GPC) using commercially available polystyrene standards (with a Mp of about 162 to about 14,000 as the calibration reference). The molecular weight (Mn) for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 0.38 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THE and prepared at concentration of 0.1-0.5 weight percent and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

As used herein and unless the context suggests otherwise, a major amount refers to greater than 50 weight percent (greater than 60 weight percent, greater than 70 weight percent, greater than 80 weight percent or greater than 90 weight percent), and a minor amount refers to less than 50 weight percent (less than 40 weight percent, less than 30 weight percent, less than 20 weight percent, or less than 10 weight percent).

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

EXAMPLES

The following examples are illustrative of exemplary embodiments of the disclosure. In these examples as well as elsewhere in this application, all ratios, parts, and percentages are by weight unless otherwise indicated. It is intended that these examples are being presented for the purpose of illustration only and are not intended to limit the scope of the invention disclosed herein. The specifications for base fuels A, B, and C used in the Examples are below in Table 1.

TABLE 1

Fuel Specifications.

| FUEL PROPERTY | BASE FUEL A | BASE FUEL B | BASE FUEL C |
|---|---|---|---|
| API Gravity | 60.3 | 58.5 | 58.7 |
| Specific Gravity | 0.7377 | 0.7447 | 0.7440 |
| Density | 0.7370 | 0.7440 | 0.7432 |
| % Benzene | 0.47 | <0.10 | n.a. |
| Bromine No. | 9.7 | <0.5 | n.a. |
| BTU Gross (btu/lb) | 18711 | 19614 | 19674 |
| BTU Net (btu/lb) | 17477 | 18409 | 18465 |
| Unwashed Gum (ASTM D-381) | 3 | 3.5 | 1.5 |
| Washed Gum (ASTM D-381) | <0.5 | <0.5 | <0.5 |
| ASTM D-525 Oxidation (minutes) | 960 | 960+ | 960+ |
| RVP (ASTM D-5191) | 9.46 | 8.76 | 8.8 |
| % Carbon | 82.63 | 86.79 | n.a. |
| % Hydrogen | 13.53 | 13.21 | n.a. |
| Aromatics (vol-%) | 27.9 | 29.1 | 30.7 |
| Olefins (vol-%) | 4.7 | 1.2 | 9.2 |
| Saturates (vol-%) | 67.4 | 69.7 | 60.1 |
| Ethanol (vol-%) | 9.3 | <0.10 | n.a. |
| Oxygen Content | 3.84 | <0.02 | 0 |
| Sulfur (ppm) | 8.4 | 30 | 4.6 |
| RON | 98.2 | 97.4 | 91.4 |
| MON | 87.5 | 89 | 83.3 |
| Octane (R + M)/2 | 92.85 | 93.2 | 87.35 |
| ASTM D-86 (Temperature ° F.) | | | |
| Initial Boiling Point | 87 | 84.6 | 91.3 |
| 5% | 99.9 | 108 | 113.7 |
| 10% | 110.5 | 121.5 | 125 |
| 20% | 125.2 | 104.6 | 140.2 |
| 30% | 140.3 | 163 | 157.1 |
| 40% | 152.5 | 191.4 | 174.2 |
| 50% | 165.6 | 215.8 | 193.3 |
| 60% | 228.4 | 228.4 | 227.1 |
| 70% | 250.5 | 237.3 | 257.8 |
| 80% | 276 | 254 | 288.5 |
| 90% | 316 | 337.5 | 332.6 |
| 95% | 343.6 | 338.4 | 368.4 |
| End Point | 398.5 | 398.7 | 423.8 |
| % Recovery | 96.1 | 97.3 | 97.2 |
| Residue | 1.1 | 1.1 | 1.1 |
| Loss | 2.8 | 1.6 | 1.7 |

Example 1

A Mannich-based quaternary ammonium salt detergent additive was prepared as follows: An 80 weight 00 solution (in Aromatic 100 solvent) of a commercial sample of a Mannich fuel detergent made with polyisobutylene (1000 MW) cresol, DMA-PA and formaldehyde (166.18 g, 150 mmol) was measured into a 500 ml round bottom reaction flask equipped with a nitrogen port and a condenser. The predominant structure for this detergent was believed to be as shown below as a compound having the structure below.

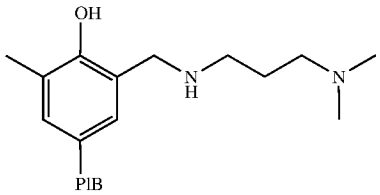

To this solution was added dimethyl oxalate (18.39 g, 156 mmol). This mixture was heated to 125° C. for 3 hours. During the heating period, the mixture was stirred under a nitrogen atmosphere. At the end of the heating period, Aromatic 150 (80 g) was added to bring the total solvent concentration to 40 weight %. A $^{13}C$ NMR spectrum of the product indicated that the quaternization of the tertiary amine had gone to completion.

Example 2

Inventive and Comparative fuel additive packages of Table 2 below were prepared for evaluation of intake valve deposits. The Mannich detergent for this Example was prepared from a high reactivity polyisobutylene cresol, dimethylamino propyl amine, and formaldehyde according to known methods (see, e.g., U.S. Pat. No. 6,800,103, which is incorporated herein by reference), the propoxylated alcohol was a blend of commercially available C16-C18 propoxylated alcohols, and the Mannich-based quaternary ammonium salt was the additive of Example 1.

TABLE 2

| Ingredients | Inventive 1 PTB | Comparison 1 PTB | Comparison 2 PTB |
|---|---|---|---|
| Mannich Detergent | 11.45 | 25 | — |
| Alkyl propoxylated alcohol | 15.2 | 20 | 15.2 |
| Mannich-Based Quaternary Ammonium Salt (Example 1) | 11.45 | — | 22.85 |

Each of the additives of Table 2 above were blended into a Base Fuel A. The base fuel with no additives and the inventive and comparison fuels was then evaluated for intake valve deposits in an Ford 2.3 L engine pursuant to ASTM D6201 engine. Results are provided in Table 3 below.

TABLE 3

| | Base fuel | Inventive 1 | Comparison 1 | Comparison 2 |
|---|---|---|---|---|
| 2.3 L IVD, mg | 690 | 58 mg | 181 mg | 71 mg |
| improvement from base IVD, % | — | 91.6% | 73.8% | 89.7% |

Example 4

In the context of GDI engines, a series of tests were run to evaluate the impact that the additive packages had on fuel injector deposits in a gasoline direct injection engine (GDI), such as a Kia Optima engine or a General Motors LHU engine. All tests were run with a consistent Base Fuel during a Dirty-up (DU), Clean-up (CU) and/or Keep Clean (KC) phases of the respective test. The additive packages of Table 4 below were tested to evaluate the ability of each fuel additive to improve injector performance by reducing injector deposits in the GDI engine. Results are shown in Table 5.

TABLE 4

Fuel Additives

| Ingredients | Inventive 2 PTB | Comparison 3 PTB | Comparison 4 PTB |
|---|---|---|---|
| Mannich Detergent* | 25.94 | 25.94 | — |
| Mannich-Based Quaternary Ammonium Salt (Example 1) | 5 | — | 5 |

*Mannich detergent from high reactivity polyisobutylene cresol, dibutyl amine, and formaldehyde.

Base fuel B was investigated for a DU level by indirect measurements of injector fouling, such as by pulse width or long term fuel trim (LTFT), on a gasoline direct injection GM LHU engine pursuant to the RIFT methods as set forth in Smith, S. and Imoehl, W., "Measurement and Control of Fuel Injector Deposits in Direct Injection Gasoline Vehicles," SAE Technical Paper 2013-01-2616, 2013, doi: 10.4271/2013-01-2616 and/or Shanahan, C., Smith, S., and/or Sears, B., "A General Method for Fouling Injectors in Gasoline Direct Injection Vehicles and the Effects of Deposits on Vehicle Performance," SAE Int. J. Fuels Lubr. 10(3): 2017, doi:10.4271/2017-01-2298, both of which are incorporated by reference herein.

In order to accelerate the DU phase of the Base Fuel, a combination of di-tert-butyl disulfide (DTBDS, 406 ppmw) and tert-butyl hydrogen peroxide (TBHP, 286 ppmw) were added to the base fuel and the DU was accelerated to provide the fouling in the range of 5 to 12%. Percent of fouling is calculated as:

$$\text{Percent of fouling} := \frac{\text{Injector pulse width} - \text{injector pulse width at start of testing}}{\text{injector pulse at start of testing}} * 100\%$$

GDI clean up (CU) deposit tests were conducted to demonstrate the removal of deposits that had been formed in the fuel injectors during the dirty-up (DU) phase. The Additive packages of Table 6 were blended into the Base Fuel B that was used for DU. The test procedure consisted of a 114 hour cycle at 2000 rpm and 100 Nm torque with continuous monitoring of injection pulse width to maintain stoichiometric Air/Fuel ratio on the GM LHU engine. After 66 hours of test operation, the fuel was changed to an additized formulation that is designed to have a clean-up effect. The percentage of injector pulse width increase, and subsequent decrease, after completion of the 114 hour cycle is one parameter for evaluating the fouling or cleaning effect of the fuel candidate. CU is calculated as in the following equation:

$$CU = \frac{\text{Injector pulse width at end of } DU - \text{injector pulse width at end of testing}}{\text{Injector pulse width at end of } DU - \text{injector pulse width at starting of testing}} * 100\%$$

TABLE 5

| GDI clean-up in Kia Optima Engine | | | |
|---|---|---|---|
| | Inventive 2 | Comparison 3 | Comparison 4 |
| GDI % clean-up (CU) | 91% | No clean-up, continuing dirty-up phase | 90%* |

*GM LHU Engine

As shown in Tables 4 and 5, Inventive sample 2 with both the Mannich detergent additive and the Mannich-based quaternary ammonium salt additive at a ratio from 5.2:1 exhibited improved injector clean-up relative to the comparative examples with either the Mannich or Mannich-based quaternary salt detergents alone. Given that a fuel additive with only a Mannich-based quaternary ammonium salt detergent (e.g., Comparison 3) had no clean-up performance in a GDI engine (and rather continued the dirty up phase), Inventive sample 2 with both the Mannich detergent and the Mannich-based quaternary ammonium salt detergent demonstrated an unexpected synergy in performance. That is, it would not have been expected that the clean-up performance with both the Mannich detergent and the Mannich-based quaternary ammonium salt would have been better than the clean-up performance of comparative sample 4 including only the Mannich detergent given that the Mannich-based quaternary ammonium salt detergent alone provided no clean-up performance (but rather continues DU).

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. A fuel additive for a spark-ignition engine comprising:

a detergent including one or more Mannich detergent additives and one or more Mannich-based quaternary ammonium salt detergent additives;

wherein the one or more Mannich detergent additives include the reaction product of a hydrocarbyl-substituted phenol or cresol, one or more aldehydes, and one or more amines;

wherein the one or more Mannich-based quaternary ammonium salt detergent additives include (i) a Mannich reaction product or derivative thereof having at least one tertiary amino group and prepared from a hydrocarbyl-substituted phenol, cresol, or derivative thereof, an aldehyde, and a hydrocarbyl amine or polyamine providing the tertiary amino group and reacted with (ii) a quaternizing agent selected from the group consisting of a carboxylic or polycarboxylic acid, ester, amide, or salt thereof or halogen substituted derivative thereof; and wherein about 2 to about 50 weight percent of the detergent is the one or more Mannich-based quaternary ammonium salt detergent additives.

2. The fuel additive of claim 1, wherein about 2 to about 20 weight percent of the detergent is the one or more Mannich-based quaternary ammonium salt detergent additives.

3. The fuel additive of claim 1, wherein the one or more Mannich detergent additives have the structure of Formula I:

(Formula I)

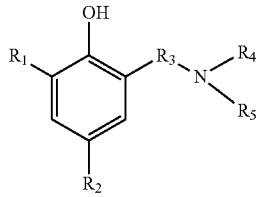

wherein $R_1$ of Formula I is hydrogen or a C1 to C4 alkyl group, $R_2$ of Formula I is a hydrocarbyl group having a number average molecular weight of about 500 to about 3000, $R_3$ of Formula I is a C1 to C4 alkylene or alkenyl group, and $R_4$ and $R_5$ of Formula I are, independently, hydrogen, a C1 to C12 alkyl group, or a C1 to C4 alkyl amino di(C1-C12 alkyl) group.

4. The fuel additive of claim 3, wherein the detergent includes two Mannich detergent additives, wherein the first Mannich detergent additive has the structure of Formula I with $R_4$ and $R_5$ each being the C1 to C12 alkyl group and the second Mannich detergent additive has the structure of Formula I with $R_4$ being hydrogen and $R_5$ being the di(C1 to C4)alkyl amino C1-C12 alkyl group.

5. The fuel additive of claim 4, wherein the first Mannich detergent additive has the structure of Formula Ia and the second Mannich detergent additive has the structure of Formula Ib:

(Formula Ia)

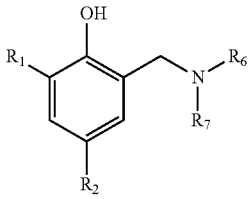

and (Formula Ib)

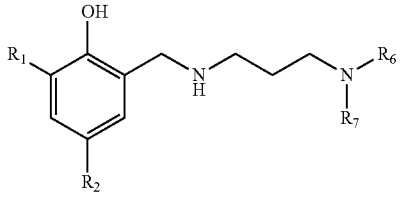

wherein each $R_1$ is independently hydrogen or a C1 to C4 alkyl group, each $R_2$ is independently a hydrocarbyl group having a number average molecular weight of about 500 to about 3000, $R_6$ and $R_7$ are, independently, a C1 to C12 alkyl group.

6. The fuel additive of claim 4, wherein a weight ratio of the first Mannich detergent additive to the second Mannich detergent additive is about 1:1 to about 2:1.

7. The fuel additive of claim 1, wherein the one or more Mannich-based quaternary ammonium salt detergent additives have the structure of Formula II (Formula II)

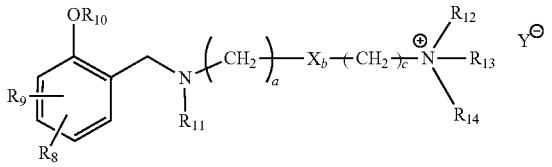

wherein $R_8$ is a hydrocarbyl radical, wherein the number average molecular weight of the hydrocarbyl is about 200 to about 5,000;

$R_9$ is hydrogen or a $C_1$-$C_6$ alkyl group;

$R_{10}$ is hydrogen or, together with $R_{11}$, a —C(O)— group or a —$CH_2$— group forming a ring structure with the nitrogen atom closest to the aromatic ring;

$R_{11}$ is one of hydrogen, $C_1$-$C_6$ alkyl, —$(CH_2)_a$—$NR_5R_6$, —$(CH_2)_a$-Aryl$(R_1)(R_2)(OR_3)$, or together with $R_{10}$, a —C(O)— group or a —$CH_2$— group forming a ring structure with the nitrogen atom closest to the aromatic ring (with each of $R_5$ and $R_6$, independently being a C1 to C12 alkyl group);

$R_{12}$ is $C_1$-$C_6$ alkyl or, together with $Y^{\ominus}$, forms a C1-C6 alkyl substituted —$C(O)O^{\ominus}$;

$R_{13}$ and $R_{14}$, independently, are $C_1$-$C_6$ alkyl;

a is an integer from 1 to 10, b is an integer selected from either 0 or 1, and c is an integer from 0 to 10;

X is oxygen or nitrogen; and $Y^{\ominus}$ is an anionic group having a structure $R_{15}C(O)O^{\ominus}$ wherein $R_{15}$ is one of (i) together with $R_{12}$ a C1-C6 alkyl group or (ii) a $C_1$-$C_6$ alkyl, an aryl, a $C_1$-$C_4$ alkylene-C(O)O—$R_2$ or a —C(O)O—$R_2$ group (with $R_2$ being a C1 to C6 alkyl group).

8. The fuel additive of claim 7, wherein $R_{12}$, $R_{13}$, and $R_{14}$ of Formula II are each $C_1$-$C_6$ alkyl and wherein $Y^{\ominus}$ is the anionic group having the structure $R_{15}C(O)O^{\ominus}$ with $R_{15}$ being the $C_1$-$C_6$ alkyl, an aryl, a $C_1$-$C_4$ alkylene-C(O)O—$R_2$ or a —C(O)O—$R_2$ group.

9. The fuel additive of claim 1, further comprising an alkoxylated alcohol, and wherein a weight ratio of the alkoxylated alcohol to the one or more Mannich detergent additives is about 1.0 or less, and wherein the alkoxylated alcohol is a polyether prepared by reacting an alkyl alcohol or an alkylphenol with an alkylene oxide selected from ethylene oxide, propylene oxide, butylene oxide, copolymers thereof, or combinations thereof.

10. The fuel additive of claim 9, wherein the alkoxylated alcohol is a polyether having the structure of Formula VI:

(Formula VI)

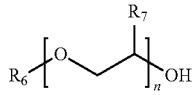

wherein $R_6$ of Formula VI is an aryl group or a linear, branched, or cyclic aliphatic group having 5 to 50 carbons, $R_7$ of Formula VI is a C1 to C4 alkyl group, and n is an integer from 5 to 100.

11. The fuel additive of claim 1, wherein the fuel additive includes about 20 to about 60 weight percent of the one or more Mannich detergent additives, about 1 to about 50 weight percent of the one or more Mannich-based quaternary ammonium salt detergent additives, and about 5 to about 30 weight percent of an alkoxylated alcohol.

12. A gasoline fuel composition comprising a detergent including one or more Mannich detergent additives and one or more Mannich-based quaternary ammonium salt detergent additives;

about 15 to about 300 ppmw of the one or more Mannich detergent additives, wherein the Mannich detergent additive is the reaction product of a hydrocarbyl-substituted phenol or cresol, one or more aldehydes, and one or more amines;

about 1 to about 200 ppmw of the one or more Mannich-based quaternary ammonium salt detergent additives, wherein the Mannich-based quaternary ammonium salt detergent additive is (i) a Mannich reaction product or derivative thereof having at least one tertiary amino group and prepared from a hydrocarbyl-substituted phenol, cresol, or derivative thereof, an aldehyde, and a hydrocarbyl amine or polyamine providing the tertiary amino group and reacted with (ii) a quaternizing agent selected from the group consisting of a carboxylic or polycarboxylic acid, ester, amide, or salt thereof or halogen substituted derivative thereof;

wherein about 2 to about 50 weight percent of the detergent is the one or more Mannich-based quaternary ammonium salt detergent additives; and about 5 to about 150 ppmw of an alkoxylated alcohol.

13. A method of reducing deposits in a gasoline engine, the method comprising:

operating a gasoline engine on a fuel composition containing a major amount of a gasoline fuel and a minor amount of a fuel additive by injecting the gasoline fuel through one or more injectors;

wherein the fuel additive includes a detergent including one or more Mannich detergent additives and one or more Mannich-based quaternary ammonium salt detergent additives; wherein the one or more Mannich detergent additives includes the reaction product of a hydrocarbyl-substituted phenol or cresol, one or more aldehydes, and one or more amines; wherein the Mannich-based quaternary ammonium salt detergent additive includes (i) a Mannich reaction product or derivative thereof having at least one tertiary amino group and prepared from a hydrocarbyl-substituted phenol, cresol, or derivative thereof, an aldehyde, and a hydrocarbyl amine or polyamine providing the tertiary amino group and reacted with (ii) a quaternizing agent selected from the group consisting of a carboxylic or polycarboxylic acid, ester, amide, or salt thereof or halogen substituted derivative thereof; and wherein about 2 to about 50 weight percent of the detergent is the one or more Mannich-based quaternary ammonium salt detergent additives; and wherein the fuel additive reduces deposits in the gasoline engine.

14. The method of claim 13, wherein the fuel additive reduces deposits in a port fuel injection (PFI) engine, a gasoline direct injection (GDI) engine, or both.

15. The method of claim 13, wherein the reduced deposits are reduced injector deposits measured by one of injector pulse width, injection duration, injector flow, or combinations thereof.

16. The method of claim 13, wherein the one or more Mannich detergent additives have the structure of Formula I:

(Formula I)

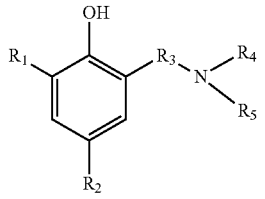

wherein $R_1$ is hydrogen or a C1 to C4 alkyl group, $R_2$ is a hydrocarbyl group having a number average molecular weight of about 500 to about 3000, $R_3$ is a C1 to C4 alkylene or alkenyl group, and $R_4$ and $R_5$ are, independently, hydrogen, a C1 to C12 alkyl group, or a di(C1 to C4)alkyl amino C1-C12 alkyl group.

17. The method of claim 13, wherein the one or more Mannich-based quaternary ammonium salt detergent additives have the structure of Formula II (Formula II)

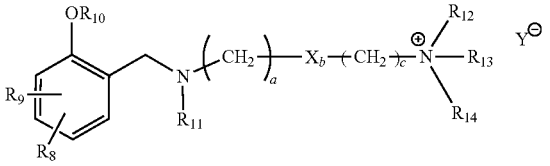

wherein $R_8$ is a hydrocarbyl radical, wherein the number average molecular weight of the hydrocarbyl is about 200 to about 5,000;

$R_9$ is hydrogen or a $C_1$-$C_6$ alkyl group;

$R_{10}$ is hydrogen or, together with $R_{11}$, a —C(O)— group or a —$CH_2$— group forming a ring structure with the nitrogen atom closest to the aromatic ring;

$R_{11}$ one of hydrogen, $C_1$-$C_6$ alkyl, —$(CH_2)_a$—$NR_5R_6$, —$(CH_2)_a$-Aryl$(R_1)(R_2)(OR_3)$, or together with $R_{10}$, a —C(O)— group or a —$CH_2$— group forming a ring structure with the nitrogen atom closest to the aromatic ring (with each of $R_5$ and $R_6$, independently being a C1 to C12 alkyl group);

$R_{12}$ is $C_1$-$C_6$ alkyl or, together with $Y^{\ominus}$, forms a C1-C6 alkyl substituted —$C(O)O^{\ominus}$;

$R_{13}$ and $R_{14}$, independently, are $C_1$-$C_6$ alkyl;

a is an integer from 1 to 10, b is an integer selected from either 0 or 1, and c is an integer from 0 to 10;

X is oxygen or nitrogen; and $Y^{\ominus}$ is an anionic group having a structure $R_{15}C(O)O^{\ominus}$ wherein $R_{15}$ is one of (i) together with $R_{12}$ a C1-C6 alkyl group or (ii) a $C_1$-$C_6$ alkyl, an aryl, a $C_1$-$C_4$ alkylene-C(O)O—$R_2$ or a —C(O)O—$R_2$ group (with $R_2$ being a C1 to C6 alkyl group).

18. The method of claim 17, wherein $R_{12}$, $R_{13}$, and $R_{14}$ are each $C_1$-$C_6$ alkyl and wherein $Y^{\ominus}$ is the anionic group having the structure $R_{15}C(O)O^{\ominus}$ with $R_{15}$ being the $C_1$-$C_6$ alkyl, an aryl, a $C_1$-$C_4$ alkylene-C(O)O—$R_2$ or a —C(O)O—$R_2$ group.

19. The method of claim 13, further comprising an alkoxylated alcohol and wherein a weight ratio of the alkoxylated alcohol to the Mannich detergent is about 1.0 or less, and wherein the alkoxylated alcohol is a polyether prepared by reacting an alkyl alcohol or an alkylphenol with an alkylene oxide selected from ethylene oxide, propylene oxide, butylene oxide, copolymers thereof, or combinations thereof.

20. The method of claim 13, wherein the fuel additive includes about 20 to about 60 weight percent of the Mannich detergent, about 1 to about 50 weight percent of the one or more Mannich-based quaternary ammonium salt detergent additives, and about 5 to about 30 weight percent of the alkoxylated alcohol.

21. The method of claim 16, wherein the detergent includes two Mannich detergent additives, wherein the first Mannich detergent additive has the structure of Formula I with $R_4$ and $R_5$ each being the C1 to C12 alkyl group and the second Mannich detergent additive has the structure of Formula I with $R_4$ being hydrogen and $R_5$ being the di(C1 to C4)alkyl amino C1-C12 alkyl group, and wherein the first Mannich detergent additive has the structure of Formula Ia and the second Mannich detergent additive has the structure of Formula Ib:

(Formula Ia)

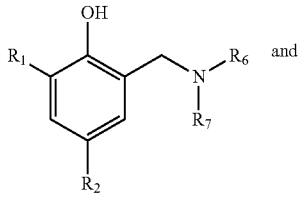

and (Formula Ib)

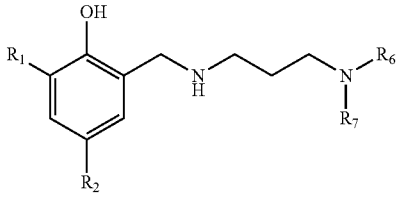

wherein each $R_1$ is independently hydrogen or a C1 to C4 alkyl group, each $R_2$ is independently a hydrocarbyl group having a number average molecular weight of about 500 to about 3000, $R_6$ and $R_7$ are, independently, a C1 to C12 alkyl group.

22. The method of claim 21, wherein a weight ratio of the first Mannich detergent additive to the second Mannich detergent additive is about 1:1 to about 2:1.

* * * * *